United States Patent [19]

Oka et al.

[11] Patent Number: 4,835,566

[45] Date of Patent: May 30, 1989

[54] ELECTROPHOTOGRAPHIC COPYING APPARATUS

[75] Inventors: Tateki Oka; Naoki Toyoshi; Tomoaki Yokoyama, all of Aichi, Japan

[73] Assignee: Minolta Camera Kabushiki Kaisha, Osaka, Japan

[21] Appl. No.: 119,833

[22] Filed: Nov. 12, 1987

[30] Foreign Application Priority Data

| | | | |
|---|---|---|---|
| Nov. 13, 1986 | [JP] | Japan | 61-270600 |
| Nov. 13, 1986 | [JP] | Japan | 61-270601 |
| Nov. 13, 1986 | [JP] | Japan | 61-270602 |
| Nov. 13, 1986 | [JP] | Japan | 61-270603 |
| Aug. 6, 1987 | [JP] | Japan | 62-197024 |
| Aug. 6, 1987 | [JP] | Japan | 62-197025 |
| Aug. 6, 1987 | [JP] | Japan | 62-197026 |

[51] Int. Cl.[4] ..... G03G 15/00; G03G 15/01; G03G 15/08

[52] U.S. Cl. ..... 355/219; 430/54; 355/245

[58] Field of Search ..... 355/3 R, 3 CH, 30 D, 355/4, 14 R, 14 CH; 430/54, 126, 902

[56] References Cited

U.S. PATENT DOCUMENTS

| | | | |
|---|---|---|---|
| 3,960,445 | 6/1976 | Drawe | 355/4 |
| 3,967,891 | 7/1976 | Rippstein | 355/3 R |
| 4,014,607 | 3/1977 | Cherian | 355/3 R |
| 4,222,660 | 9/1980 | Furuichi et al. | 355/14 R |
| 4,346,982 | 8/1982 | Nakajima et al. | 355/3 R |
| 4,386,769 | 6/1983 | Ito et al. | 271/9 |
| 4,416,535 | 11/1983 | Tottori | 355/14 D |
| 4,480,909 | 11/1984 | Tsuchiya | 355/14 CH |
| 4,483,606 | 11/1984 | Kuwako et al. | 355/3 DD |
| 4,562,130 | 12/1985 | Oka | 430/54 |
| 4,618,249 | 10/1986 | Minor | 355/14 CH |
| 4,636,060 | 1/1987 | De Schamphelaere et al. | 355/14 CH |
| 4,669,854 | 6/1987 | Ichikana et al. | 355/14 CH X |
| 4,750,019 | 6/1988 | Kamitani | 355/14 CH |

FOREIGN PATENT DOCUMENTS

| | | |
|---|---|---|
| 51-134635 | 11/1976 | Japan . |
| 54-30833 | 3/1979 | Japan . |

OTHER PUBLICATIONS

IBM Technical Disclosure Bulletin, vol. 12, No. 8, Jan. 1970.

*Primary Examiner*—A. C. Prescott

*Attorney, Agent, or Firm*—Wenderoth, Lind & Ponack

[57] ABSTRACT

A first developing device is provided in a demountable manner near a photoconductor drum of an electrophotographic copying apparatus. There is further provided a second developing device most downstream along a direction of rotation of the photoconductor drum. Developer containing color toner is stored in the first developing device and developer containing black toner is stored in the second developing device. An outline image forming unit for forming an outline image can be installed in place of the first developing device. When the first developing device is installed, development of a copy image is effected by either the first developing device or the second developing device. When the outline image forming unit is installed in place of the first developing device, an outline image formed by the outline image forming unit is developed by the second developing device.

24 Claims, 26 Drawing Sheets

ELECTROPHOTOGRAPHIC COPYING APPARATUS

CROSS-REFERENCE TO RELATED CO-PENDING APPLICATIONS

Related co-pending applications of particular interest to the present application are as follows: U.S. patent application Ser. No. 16,716, entitled "Method for the Formation of Outline Images Corresponding to the Peripheral Outlines of Document's Images", filed Feb. 19, 1987; U.S. patent application Ser. No. 16,717, entitled "Method for the Formation of Outline Images Corresponding to the Peripheral Outlines of Document's Images", filed Feb. 19, 1987; U.S. patent application Ser. No. 46,944, entitled "Electrophotographic Copiers", filed May 7, 1987; and U.S. patent application Ser. No. 58,266, entitled "Method for the Formation of Outline Images Corresponding to the Peripheral Outlines of Document's Images", filed May 21, 1987, all being assigned to the same assignee of the present application.

The assignee of the present application proposed, in the above mentioned applications, electrophotographic copying methods for obtaining outline images by recharging an electrostatic latent image by operation of a second charger provided between an exposing device and a developing device. According to those methods, if copy operation is performed when the second charger is turned on, the electrostatic latent image formed on the surface of the photoconductor is processed as the outline image prior to development by the developing device.

BACKGROUND OF THE INVENTION

1. Field of the Invention

The present invention relates to an electrophotographic copying apparatus. More particularly, the present invention relates to an electrophotographic copying apparatus capable of forming images in a color mode and in an outline image forming mode.

2. Description of the Prior Art

Recently, there have been proposed various electrophotographic copying apparatus capable of copying not only images in black but also images in red, blue and other colors. Such an apparatus usually comprises two kinds of developing devices between an exposure device and a transfer device. One of the developing devices is used as an ordinary developing device having developer containing black toner and the other developing device is used as a color developing device having developer containing color toner. Thus, either of the developing devices is selectively operated.

Generally speaking, the peripheral outline of an image is in practice full of necessary information thereabout and represents sufficiently the characterizing features of the given image, thus playing among others a most important role in the judgment of the latter. The so-called outline image forming means is adapted such that a peripheral outline is picked up from a generally full and positive documentary image and is devoid of intermediate tones or reversely, solid representations, thus being most effective for the identification of the practical image and for pattern recognition purpose thereof.

For example, complex color image patterns can be obtained by such an apparatus in a manner of forming by execution of successive copying operations a blank pattern encircled by a color outline or preparing a blank pattern for later producing differently colored local image areas contained therein.

SUMMARY OF THE INVENTION

A principal of object of the present invention is to provide an electrophotographic copying apparatus capable of performing color printing and also capable of recharging a latent image.

Briefly stated, the electrophotographic copying apparatus of the present invention comprises an electrostatic latent image bearing member, first charging means, exposing means, a plurality of developing means and transfer means, the plurality of developing means being selectively operated to form copy images of different colors, and in the electrophotographic copying apparatus, second charging means for recharging a latent image can be mounted instead of one of the developing means except for that located in the most downstream position in a moving direction of the electrostatic latent image bearing member.

According to the present invention, any one of the plurality of developing means is selected to obtain a copy image of a desired color and if the second charging means is mounted in replacement of any one of the developing means, the latent image can be recharged. Thus, the electrophotographic copying apparatus of the present invention is more convenient for the user.

In addition, since the second charging means is placed in a space occupied by one of the developing means, an additional space is not required and accordingly it is not needed to increase the size of the photoconductor or the size of the copying apparatus.

According to another aspect of the present invention, there is provided first mode designating means for designating an outline image forming mode for forming an outline image. According to another aspect, there is further provided control means for operating the second charging means when it is attached, to automatically select a first mode. According to a further aspect, the second charging means includes a grid and there is further provided a power supply for applying a developing bias voltage to each of the plurality of developing means, so that the power supply is electrically connected to the grid of the second charging means when the second charging means is mounted.

According to a further aspect of the present invention, a demountable unit is provided in place of one of the developing means excluding the one located in the most downstream position along the moving direction of the electrostatic latent image bearing member. This demountable unit comprises second charging means for recharging the latent image formed on the surface of the electrostatic latent image bearing member and an insulating seal member is provided in a lower portion of the unit so as to be in contact with the surface of the electrostatic latent image bearing member when the unit is mounted in the main body of the electrophotographic copying apparatus.

According to a further aspect of the present invention, there is provided control means for automatically operating a predetermined one of the developing means when the first mode is designated.

According to a still further aspect of the present invention, there is provided control means for selecting the developing means located in the most downstream position in the moving direction of the electrostatic latent image bearing member when the second charging means is mounted, thereby to automatically perform operation in the first mode.

These objects and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

In the following, the preferred first embodiment of the electrophotographic coping apparatus in accordance with the present invention will be described with reference to the drawings.

Figure 1:
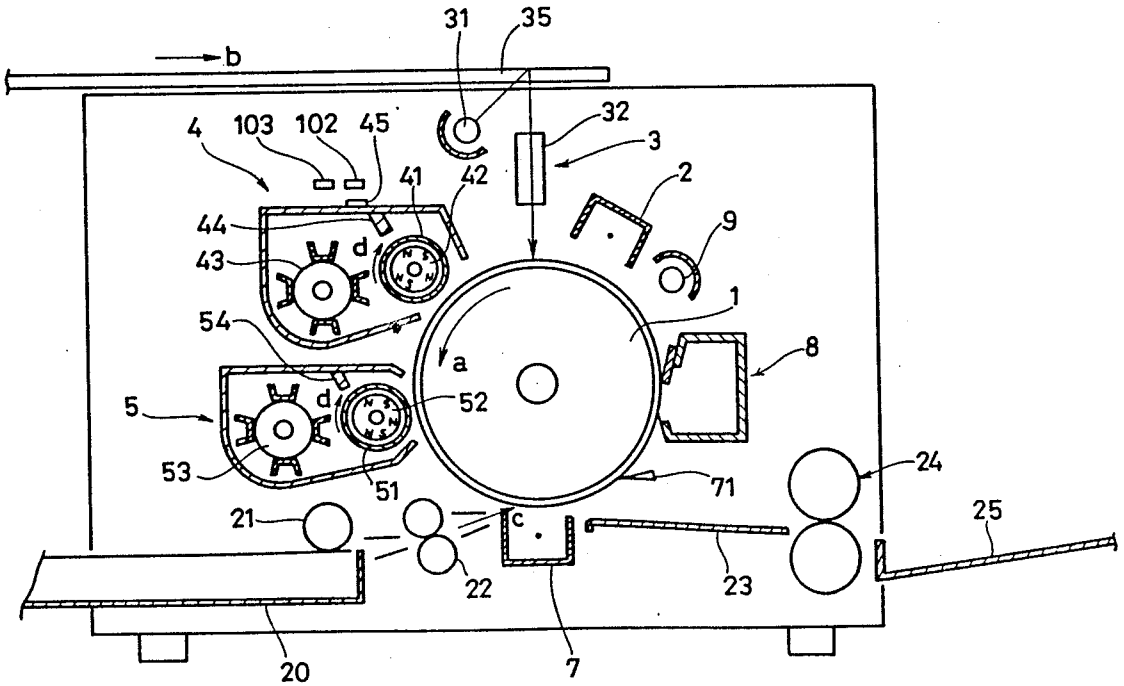
FIG. 1 is a schematic view of an electrophotographic copying apparatus of a preferred first embodiment of the present invention, in which a first developing device is mounted.
Figure 2:
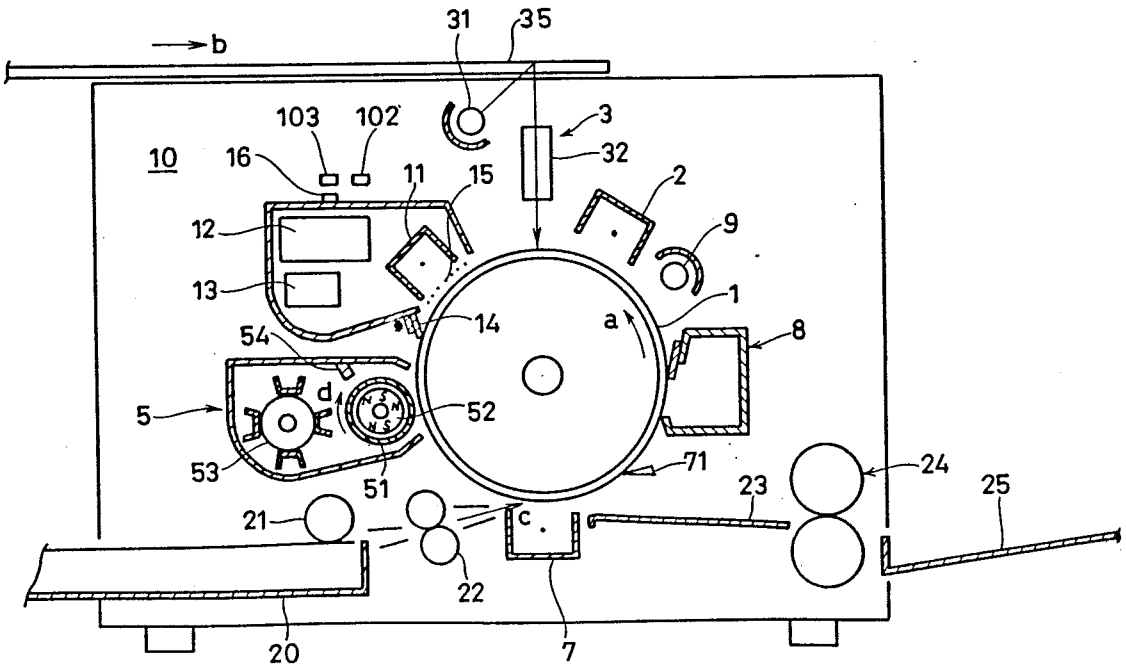
FIG. 2 is a schematic view of the electrophotographic copying apparatus of the first embodiment, in which an outline image forming unit is mounted in place of the first developing device.

FIGS. 1 and 2 show the electrophotographic copying apparatus of this first embodiment. FIG. 1 shows a case in which a first developing device 4 is mounted in the apparatus and FIG. 2 shows a case in which an outline image forming unit 10 is mounted in the apparatus in place thereof. A well-known photoconductor drum 1 having a photoconductive layer on its outer surface is provided nearly in a central portion of this copying apparatus. The photoconductor drum 1 is driven to rotate in a direction shown by the arrow a by means of a main motor (not shown). The following components are provided around the drum 1.

A static charger 2 functions as a first charging device for applying electric charge of a given potential (i.e., electric charge of a positive polarity in this embodiment) to the surface of the photoconductor drum 1.

An exposure device 3 applies light to an original placed on a document glass table 35, moving along a direction of the arrow b, to form an electrostatic latent image on the surface of the photoconductor drum 1 corresponding to an original image by a well-known slit exposure system. The exposure device 3 comprises an exposure lamp 31, a lens array 32 including a focusing photo-transmitting unit, and the like. The original to be used is for example a positive one.

A first developing device 4 and a second developing device 5 serve to cause the electrostatic latent image formed on the surface of the photoconductor drum 1 to be a visible toner image by a magnetic brush system. The first developing device 4 has a shape shown in FIG.

3 and is demountable. The second developing device 5 is fixed in the electrophotographic copying apparatus. The first developing device 4 comprises a developer sleeve 41 and a bucket roller 43 for agitation of developer. The developer sleeve 41 has a magnet roller 42 fixedly mounted inside the sleeve. The magnet roller 42 has a number of alternating N and S poles at its periphery. The second developing device 5 comprises a developer sleeve 51 containing a magnet roller 52, and a bucket roller 53 in the same manner as in the first developing device 4. A first developing motor and a second developing motor are provided in association with the first developing device 4 and the second developing device 5, respectively, to rotate the respective developer sleeves and bucket rollers. The first developing device 4 has developer containing color toner and the second developing device 5 has developer containing black toner. Either of the developing devices is selectively used in a standard copy mode to be described below.

The developer is mixture of magnetic carrier and insulating toner, which are charged with opposite polarities by frictional electrification. The developer in the first developing device 4 is held in a brush form on the surface on the developer sleeve 41 due to magnetic force of the magnetic roller 42 and the height of the developer thereof is regulated by a developer height regulator plate 44, so that the developer is transported in a direction of the arrow d to the surface of the photoconductor drum 1, where the electrostatic latent image is developed. The electrostatic latent image is developed also by means of the second developing device 5 in the same manner as in the above described first developing device 4.

A transfer charger 7 applies an electric field to a back surface of copy paper transported in a direction of the arrow c, so that the toner image formed on the surface of the photoconductor drum 1 by means of the developing device 4 or 5 is transferred onto the copy paper.

A separation claw 71 is used to separate the copy paper having the transferred image from the surface of the photoconductor drum 1. A cleaning device 8 serves to remove residual toner on the surface of the photoconductor drum 1 by a blade system. An eraser lamp 9 serves to remove residual electric charge from the surface of the photoconductor drum 1 by irradiation of light, so that the copying apparatus is prepared for the subsequent copy process.

Sheets of copy paper are contained in an automatic feed cassette 20, from which they are fed one by one in the order starting from the outermost one through a feed roller 21 and transported between the photoconductor drum 1 and the transfer charger 7 through timing rollers 22 with timing corresponding to the image formed on the photoconductor drum 1. Thus, the toner image is transferred onto the copy paper and the copy paper is separated from the photoconductor drum 1 by means of the separation claw 71 and sent to a fixing device 24 through a guide plate 23, where toner is fixed. Then the copy paper is discharged onto a tray 25.

Figure 3:
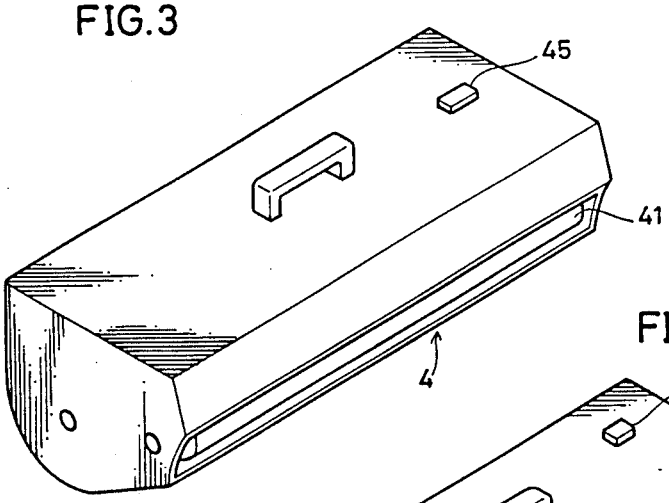
FIG. 3 is a perspective view of the first developing device applied to the first and second embodiments.
Figure 4:
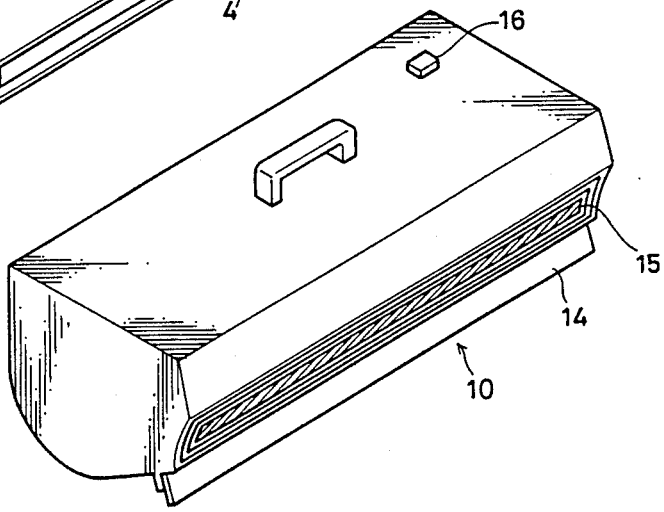
FIG. 4 is a perspective view of the outline image forming unit applied to the first and second embodiments.

The outline image forming unit 10 has substantially the same shape as that of the first developing device 4 of FIG. 3, as shown in FIG. 4. This unit 10 is demountable and is installed in the copying apparatus in place of the first developing device 4. This unit 10 contains a scorotron-charger 11 functioning as a second charging device, a high-voltage power supply 12 and a potential divider 13. The scorotron-charger 11 has a grid 15 shown by a hatched area in FIG. 4. A seal member 14 is provided in a bottom portion of the unit 10 to face the surface of the photoconductor drum 1. The seal member 14 is formed by a flexible insulating material such as a polyester film or polyurethane rubber. A leading edge of the seal member 14 is brought into contact with the surface of the photoconductor drum 1 when the unit 10 is installed in the copying apparatus. Thus, particles of toner produced from the second developing device 5 at the time of copy operation can be shut off to prevent a charge wire 18 or the grid 15 of the scorotron-charger 11 from being soiled by toner particles. Since the seal member 14 is an insulating material, it does not cause any disturbance on the electrostatic latent image on the photoconductor drum 1.

A magnet 16 is provided on an upper surface of the unit 10, while a magnet 45 is provided on an upper surface of the first developing device 4 When the unit 10 is installed in the main body of the copying apparatus, the magnet 16 turns on a switch 103. When the first developing device 4 is installed in the main body of the copying apparatus, the magnet 45 turns on a switch 102. Thus, it can be determined whether the unit 10 or the first developing device 4 is installed.

Now, connections in the developing devices 4 and 5 and the outline image forming unit 10 will be described.

Figure 5A:
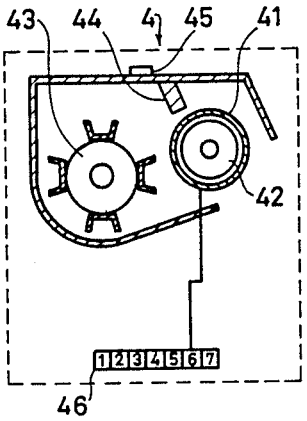
FIG. 5A is an illustration for explaining connections of the first developing device applied to the first and second embodiments.

Referring to FIG. 5A, the first developing device 4 has a connector 46 and a sixth pin of the connector 46 is connected to the developer sleeve 41.

Figure 5B:
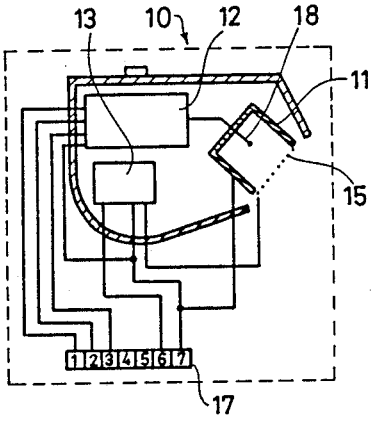
FIG. 5B is an illustration for explaining connections of the outline image forming unit applied to the first and second embodiments.

Referring to FIG. 5B, the outline image forming unit 10 has a connector 17 of the same form as that of the connector 46. First to seventh pins of the connector 17 are connected as follows.

1st pin: to an input terminal (+24V) of the high-voltage supply 12

2nd pin: to an input terminal (+0V) of the high-voltage supply 12

3rd pin: to a remote terminal of the high-voltage supply 12

4th and 5th pins: open

6th pin: to an H input terminal of the potential divider 13

7th pin: to an L input terminal of the potential divider 13 and a casing of the scorotron-charger 11

In the unit 10, an output terminal of the high-voltage supply 12 is connected to the charge wire 18 of the scorotron-charger 11 and an output terminal of the potential divider 13 is connected to the grid 15.

Figure 7:
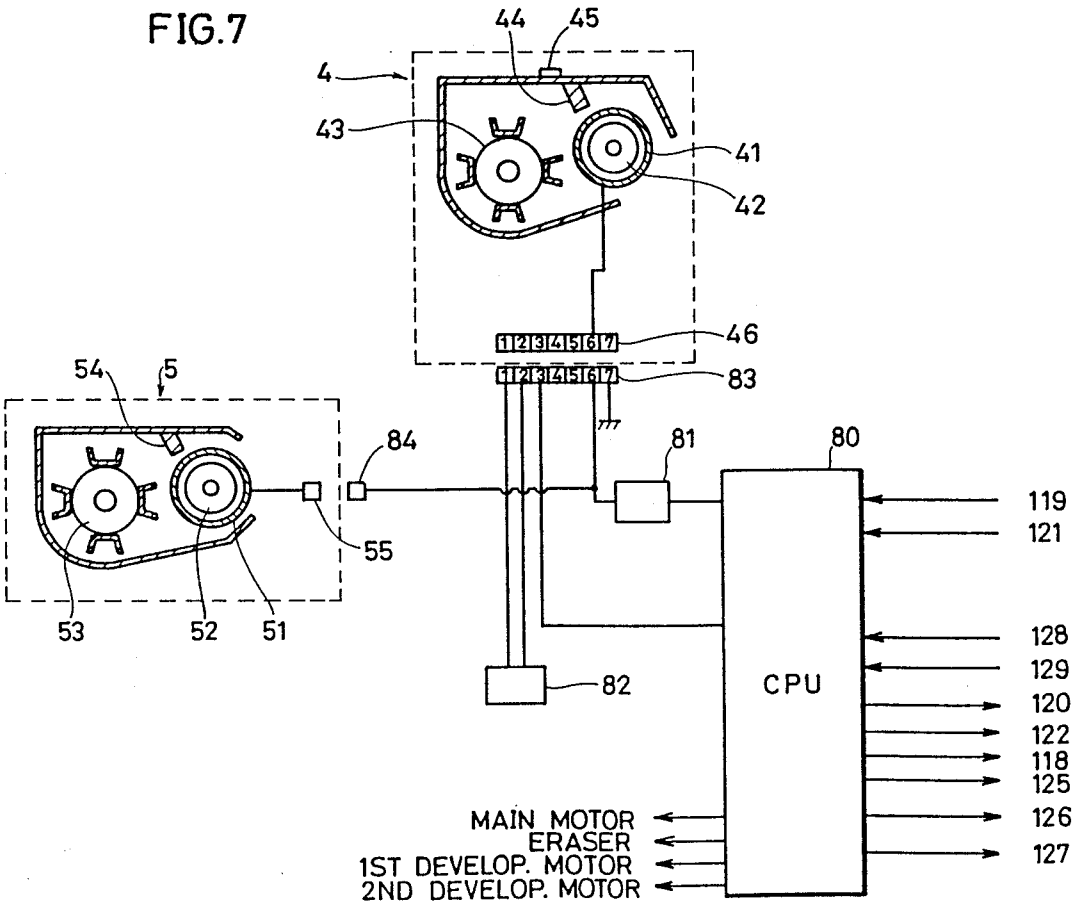
FIG. 7 is a block diagram of a control circuit, in which the first developing device is mounted in the first embodiment.
Figure 8:
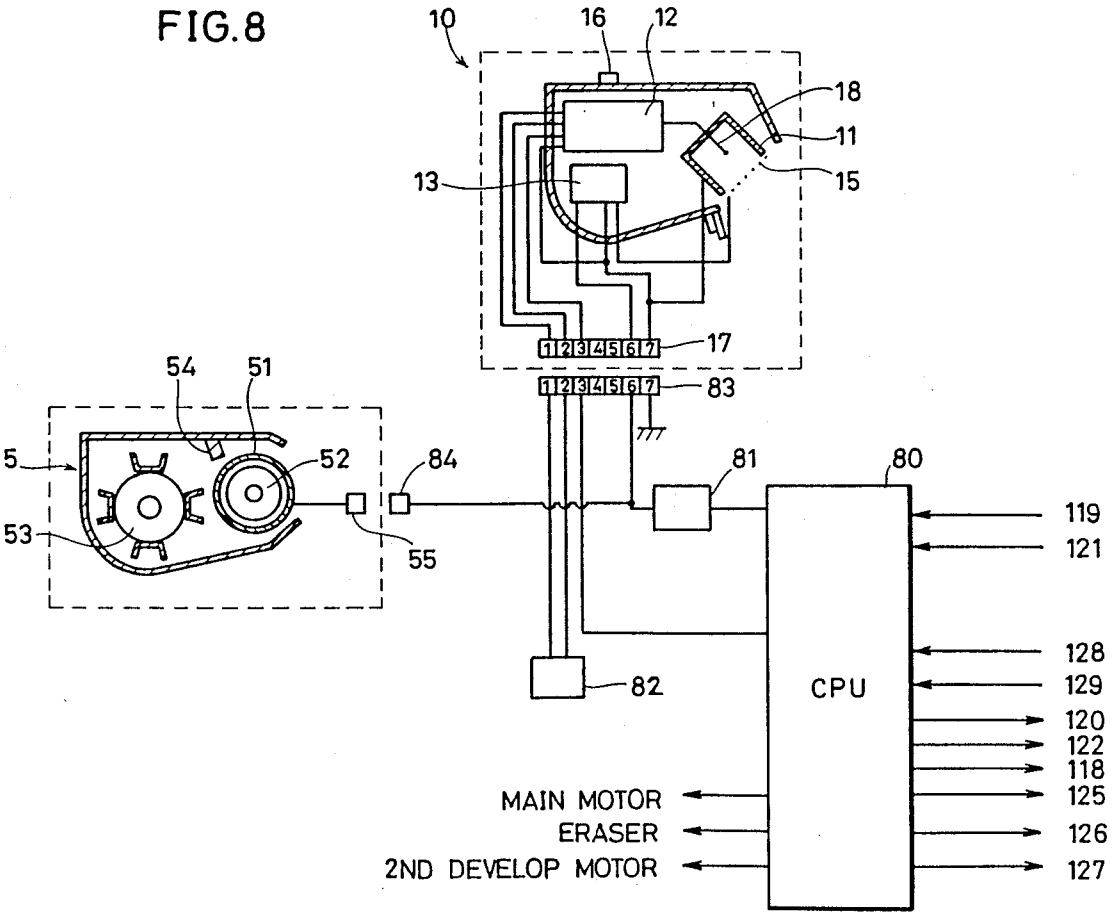
FIG. 8 is a block diagram of a control circuit, in which the outline image forming unit is mounted in the first embodiment.

On the other hand, the second developing device 5 has a connector 55 connected to the developer sleeve 51 as shown in FIGS. 7 and 8.

Figure 6:
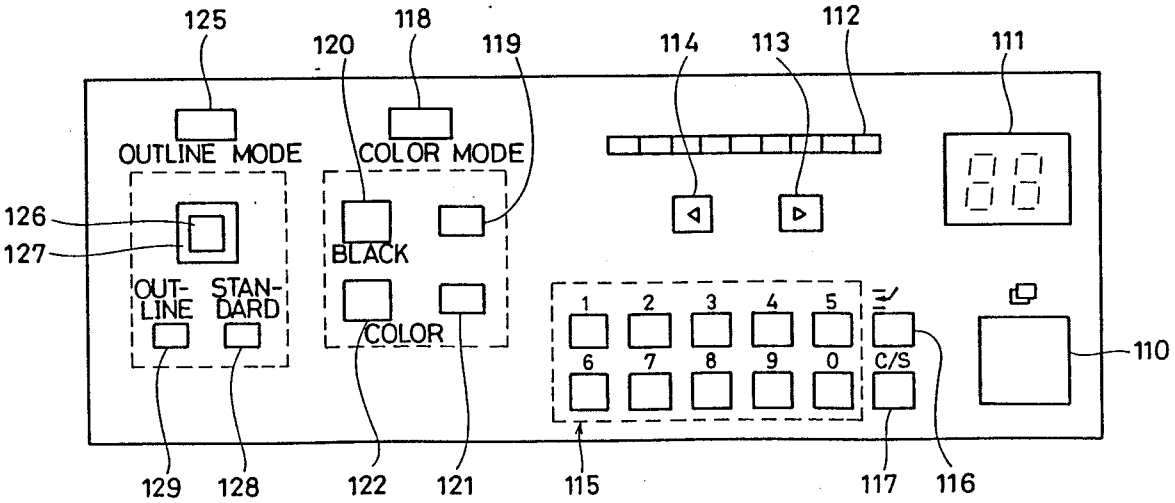
FIG. 6 is a plan view of an operation panel in the first embodiment.

Referring now to FIG. 6, description is made of keys and display portions on the operation panel.

A print key 110 is used to instruct a start of copy operation. A display portion 111 displays the number of copies or the like. An up-key 113 and a down-key 114 are used to regulate an image density. A degree of the image density is displayed by a display LED group 112. The image density is regulated by increasing or decreasing an amount of light of the exposure lamp 31. Ten-keys 115 serve to input the number of copies. An interruption key 116 is used to instruct an interruption. A clear/stop key 117 is used to temporarily stop consecutive copy operations to reset a display of the display portion 111 to 1.

A color mode display LED 118 is turned on when the first developing device 4 is mounted, to indicate that the apparatus is ready for standard copy in black or color.

A selection key 119 is used to select copy in black by operation of the second developing device 5. When this key 119 is operated, a display LED 120 is turned on. A selection key 121 is used to select color copy by operation of the first developing device 4. When this key 21 is operated, a display LED 122 is turned on.

An outline image forming mode display LED 125 is turned on when the outline image forming unit 10 is mounted in place of the first developing device 4, to indicate that the apparatus is ready for copying outline portions of an original image. A selection key 128 is used to select a standard copy mode. When this key 128 is operated, a display LED 126 is turned on. A selection key 129 is used to select an outline image forming mode. When this key 129 is operated, a display LED 127 is turned on.

Even if the outline image forming unit 10 is mounted in the copying apparatus, an image corresponding to an original image with a relation of 1:1 can be formed if copy operation is performed with the scorotron-charger 11 being turned off. The selection key 128 serves to select the standard copy mode in such situation.

FIGS. 7 and 8 show a control circuit of the copying apparatus. Particularly, FIG. 7 shows a case in which the first developing device 4 is mounted and FIG. 8 shows a case in which the outline image forming unit 10 is mounted in place thereof.

A microcomputer is provided in the electrophotographic copying apparatus.

Control operation is performed by a CPU 80 of the microcomputer as the center. More specifically, the CPU 80 receives signals for turning on or off the selection keys 119, 121, 128 and 129, and outputs signals for turning on or off the display LED's 118, 120, 122, 125, 126 and 127 etc. In addition, the CPU 80 outputs signals for turning on or off the main motor of the main body of the copying apparatus, the eraser lamp 9, the first and second developing motors etc..

A developing bias voltage supply 81 is controlled by a signal from the CPU 80 to supply a predetermined bias voltage to the sixth pin of the connector 83 and the pin of the connector 84. The first and second pins of the connector 83 are connected to a DC power supply 82 and the third pin thereof is connected to the CPU 80, the seventh pin thereof being grounded.

The connector 17 or 46 is automatically connected when the outline image forming unit 10 or the first developing device 4 is mounted in the main body of the copying apparatus.

When the first developing device 4 is mounted, the predetermined developing bias voltage is applied to the developer sleeve 41 through the sixth pins of the connectors 83 and 46, as shown in FIG. 7.

When the outline image forming unit 10 is mounted, a voltage of +24V is constantly applied from the DC power supply 82 to the high-voltage power supply 12 through the first and second pins of the connectors 83 and 17. An active state and a non-active state of the output of the high-voltage power supply 12 to which the voltage is applied from the DC power supply 82 are controlled by a control signal from the CPU 80. The control signal is supplied to the high-voltage supply 12 through the third pins of the connectors 83 and 17. The bias voltage is applied from the developing bias voltage supply 81 to the potential divider 13 through the sixth pins of the connectors 83 and 17. The potential divider 13 divides and lowers the applied bias voltage to a predetermined voltage, which is applied to the grid 15.

On the other hand, the predetermined developing bias voltage is applied from the developing bias voltage supply 81 to the developer sleeve 51 of the second developing device 5 through the connectors 84 and 55.

A voltage of a polarity opposite to that of the voltage applied to the static charger 2 is applied for example from the high-voltage power supply 12 to the charge wire 18 of the scorotron-charger 11.

In addition, the potential divider 13 applies, to the grid 15, a voltage having the same polarity as that of the voltage applied to the static charger 2 for example. The voltage applied to the grid 15 is sufficiently lower than a surface potential of an electrostatic latent image area and slightly higher than a surface potential of a non-image area.

If non-magnetic toner is used as the insulating toner, a developing bias voltage of the same polarity as that of the static charger 2, slightly higher than the voltage applied to the grid 15 for example is applied from the developing bias voltage supply 81 to the developer sleeve 51. The developing bias voltage is set substantially to a value slightly higher than a surface potential of a central portion of the electrostatic latent image area where potential is lowered by corona discharge of the scorotron-charger 11.

More specifically, the following polarities and voltage values are adopted.

static charger: power supply voltage positive, +5.5 kV scorotron-charger: power supply 12 negative, −6.0 kV grid: potential divider 13 positive, +150V distance between grid and drum (dg): 1.5 mm developing bias voltage: power supply 81 positive, +200V transfer charger: power supply voltage positive, +5.5 kV insulating toner: negative It should be noted that the above mentioned polarities may be all reversed. The voltage values enlisted above are given only by way of example and thus may be varied according to occasional demands.

The method for forming an image with use of the above described copying apparatus will be set forth stepwise hereinbelow.

I. Outline Image Forming Mode:

This outline image forming mode is selected when the selection key 129 is turned on.

(i) First charging step

A static charge at a predetermined potential level is applied evenly on the photoconductor drum 1 by the static charger 2. As a result, the surface potential of the drum 1 will amount to +600V.

(ii) Exposure step

Exposure of an original image is applied to the drum surface charged with +600V in the foregoing step. The exposure may be carried into effect by the slit exposure means as conventionally, so as to form the corresponding electrostatic latent image thereon. In this case, as shown in FIGS. 9 and 10A, the charge remaining in image areas A and B amounts to +600V potential, while the charge existing in non-image or blank areas devoid of the image is reduced to +80V or so under the influence of the projection of light.

(iii) Second charging step

The scorotron-charger 11 supplied with a voltage of −6.0 kV from the power supply 12 applies electric charge onto the drum surface, on which the latent image has been formed in the foregoing step. At this time, a voltage of 150V is applied to the grid 15 from the potential divider 13. The charge at the scorotron-charger 11 is of the polarity opposite to that adopted in the static charger 2, while the voltage as applied to the grid 15 is sufficiently lower than that prevailing in the electrostatic latent image areas, +600V, and of the same polarity as was adopted in the static charger 2. Additionally, the voltage applied to the grid 15 is higher than the surface potential +80V in the non-image blank areas on the drum.

Figure 9:
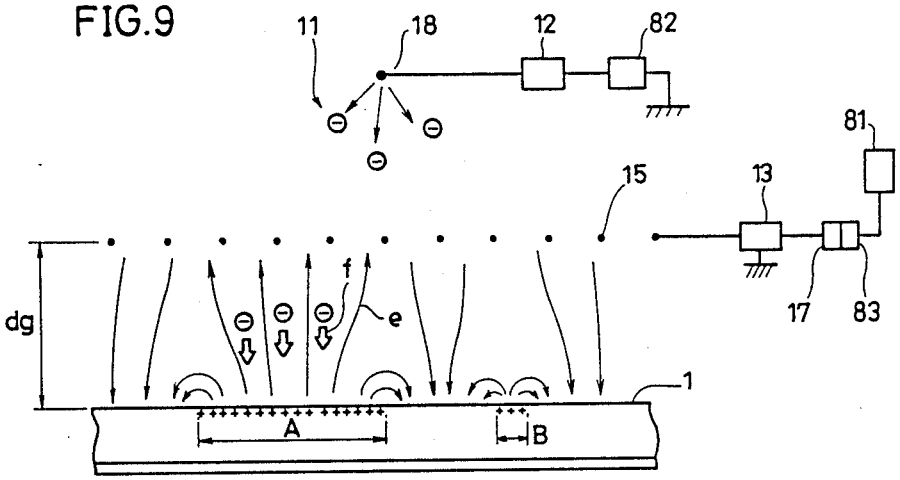
FIG. 9 is an illustration of electric force lines in a second charging step of a copying method applied to the first and second embodiments.
Figure 10A:
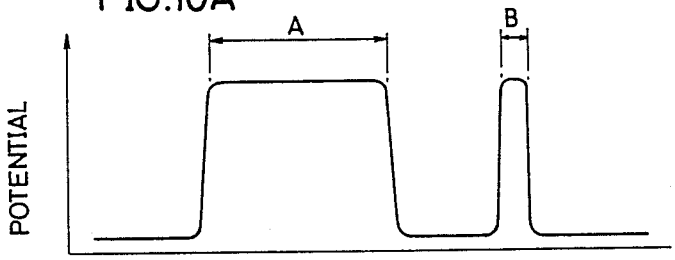
FIGS. 10A to 10C are diagrams showing potentials in electrostatic latent image areas in the steps of the copying method in the case of FIG. 9.
Figure 10B:
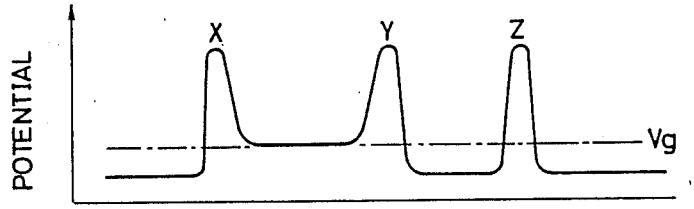

As a result, lines of electrical force as shown by arrows e in FIG. 9 appear between the surface of the drum 1 and the grid 15, and negative ions issuing from the related charge wire 18 will receive conveying forces along the lines of force mentioned above. In this case, the lines of force accelerating the negative ions, in proximity of the grid 15 toward the surface of the drum 1, are only effective in the substantive imaged portions devoid of peripheral outlines per se of the image areas A. Therefore, the negative ions can arrive exclusively at the substantive portions defined by and devoid of marginal outlines of the imaged areas A, as shown by double lined small arrows f. In this way, the potential of the ion-impinged substantive areas will have been lowered nearly to such a value as the substantially same level as the grid potential, +150V. In other words, when turning to the corresponding drum surface potential differentials thereby formed, referring to FIG. 10B, the surface potential in the non-image areas will be left at a lower potential level nearly equal to +80V. On the other hand, the inside strip-shaped zones X and Y, when seeing in plan, residing inside the marginal outline of the image area A and existing therealong, as well as the line-shaped slender imaged portion Z of the image area B, each having a substantial constant width, will remain substantially at a constant and high level, +600V, which corresponds to the initial surface potential, while the potential at the central portion of the image area A will be reduced to that equal to the grid voltage (Vg: +150V) or so. Additionally, the slender, line-like B is not subjected to surface potential reduction, while the width of the charged zone will be somewhat reduced. In other words, outlines of the image areas A and B have been formed in positive latent images.

(iv) Developing step

The positive outline images thus formed in the second charging step are further subjected to the developer step by operation of the second developing device 5. When the insulating toner is non-magnetic, the developer sleeve 51 is supplied with a developing bias voltage of +200V, as an example. This developing bias voltage Vb is selected to be somewhat higher the grid voltage Vg+150V, as an example, and higher than the substantive imaged area potential at A which has been caused to lower to such a value as substantially equal to the grid voltage Vg, and having the same polarity as was employed in the static charger 2, and indeed, for the purpose of preventing superfluous and fouling toner deposition, not only in the non-image areas, but also in the image areas, surface potentials in these areas having been caused to lower considerably in the second charging step, as was referred to hereinabove.

Figure 10C:
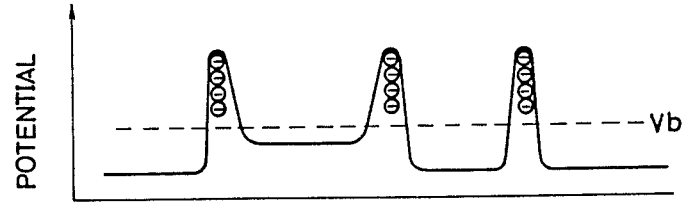

Under these operating conditions, and as shown in FIG. 10C, the negatively charged insulating toner particles will be deposited onto the higher potential regions on the drum surface, or more specifically, exclusively onto an inner slim edge portion of each of the marginal outline portions inside around the image areas A and B, thereby a kind of tonered "embroidering" inside edge lines being formed upon execution of a regular and normal development job. Then, these tonered images are transferred onto the copy paper upon execution of negative discharge at the transfer charger 7 and then subjected to a fixing process in the conventional fixing device, not shown, to provide a corresponding photocopied image.

II. Standard Copy Mode:

In the standard copy mode, a copy image corresponding to an original image with a relation of 1:1 is obtained. This standard copy mode is automatically selected when the first developing device 4 is mounted. In this case, when the selection key 119 or 121 is turned on, the developing device 5 or 4 is selected to select copy in black or in color. On the other hand, if the outline image forming unit 10 is mounted, the selection key 128 is turned on to select the standard copy mode.

(i) First charging step

This step is applied in the same manner as in the case of the above described outline image forming mode.

(ii) Exposure step

This step is applied in the same manner as an the case of the above described outline image forming mode. In this step, a positive electrostatic latent image shown in FIG. 10A is formed.

(iii) Second charging step

If the outline image forming unit 10 is mounted, the power supply 12 and the potential divider 13 are both turned off and the scorotron-charger 11 is never operated. Accordingly, the positive electrostatic latent image formed in the exposure step is directly subjected to development in the second developing device 5. On the other hand, if the first developing device 4 is mounted and a color copy mode is selected, the positive electrostatic latent image is subjected to development in the first developing device 4.

(iv) Developing step

In this developing step, the negatively charged insulating toner (for black or colors) adheres to the image areas A and B shown in FIG. 10A, so that a toner image corresponding to the original image with a 1:1 relation is formed regularly. In this case, the developing bias voltage is +200V.

Referring now to the flow charts of FIGS. 16 to 20C, control procedures by the CPU 80 will be described in the following.

Figure 16:
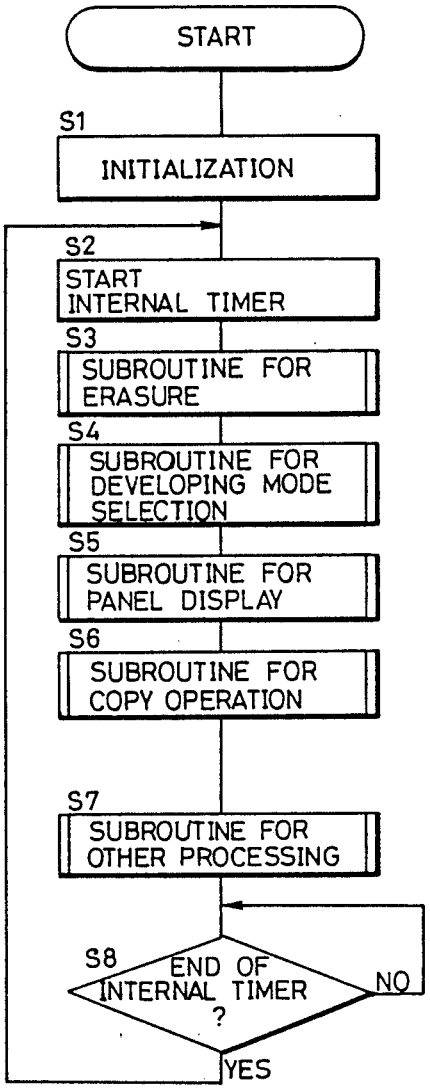
FIG. 16 is a flow chart of a main routine of a microcomputer applied to both of the first and second embodiments.

FIG. 16 shows a main routine of the CPU 80.

When power supply is turned on, the CPU 80 is reset to an initial state. First in the step S1, the CPU 80 performs initialization, that is, it clears an RAM, initializes the registers of the CPU and sets the devices in the initial mode. Then in the step S2, the CPU 80 starts measuring operation of an internal timer. The internal timer determines a period required for one cycle of the main routine irrespective of contents of processing in the respective subroutines. The timer value is set in the step S1.

Subsequently, the CPU 80 successively calls the subroutines of the steps S3 to S7. When processing operations in all of the subroutines are completed, the CPU 80 waits for an end of measuring operation of the internal timer and then instructs return to the step S2.

The subroutine of the step S3 is executed to remove electric charge on the photoconductor drum 1, as described in detail afterwards.

The subroutine of the step S4 is executed to set operating conditions of the developing devices 4 and 5 according to the selected copy mode, as described in detail afterwards.

The subroutine of the step S5 is applied to display, on the operation panel, a copy mode selected by turn-on or turn-off of the mode selection keys 119, 121 etc. of the operation panel, as described in detail afterwards.

The subroutine of the sep S6 is executed to control copy operation. Copy operation in a selected copy mode is performed when the print key 110 is turned on. Particularly, if any key on the panel is not operated within a predetermined period after an end of copy operation in the outline image forming mode, the mode is returned to the standard copy mode. This will be described in detail afterwards.

The subroutine of the step S7 is executed to perform other processing such as regulation of a fixation temperature, a detailed description thereof being omitted.

Figure 17:
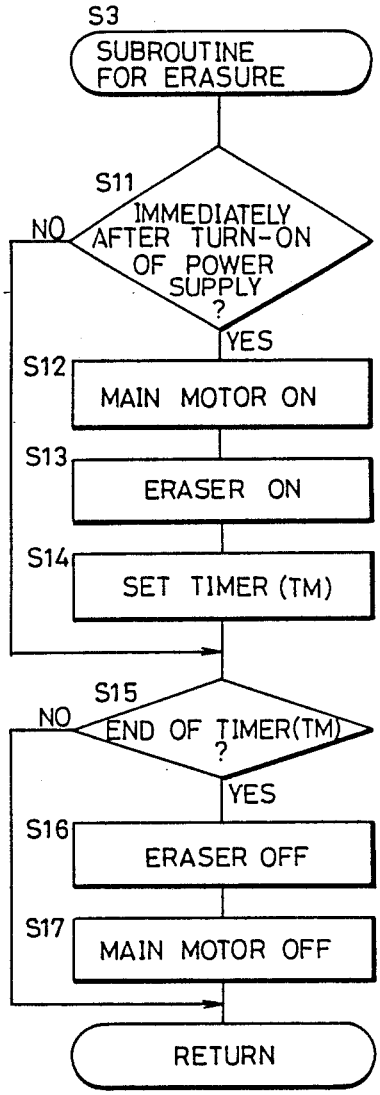
FIG. 17 is a flow chart of an erasure subroutine included in the main routine of FIG. 16, applied to both of the first and second embodiments.

FIG. 17 shows a subroutine for erasure to be executed in the above-mentioned step S3.

First, in the step S11, it is determined whether the power supply has been just turned on or not (that is, the time elapsed after turn-on of the power supply is within a predetermined period or not). If not, the CPU 80 proceeds to the step S15. If so, the main motor is turned in the step S12 and the eraser lamp 9 is turned on in the step S13. As a result, erasure of electric charge on the photoconductor drum 1 is started. At the same time, the CPU 80 starts measuring operation of a timer TM in the step S14. The timer TM is set to a period required for the erasure.

In the step S15, the CPU 80 determines whether the measuring operation of the timer TM comes to an end or not. If it does not come to an end, the CPU 80 instructs the program to return to the main routine. If it comes to an end, the erasure lamp 9 is turned off in the step S16 and the main motor is turned off in the step S17, and then, the program is returned to the main routine.

Figure 18:
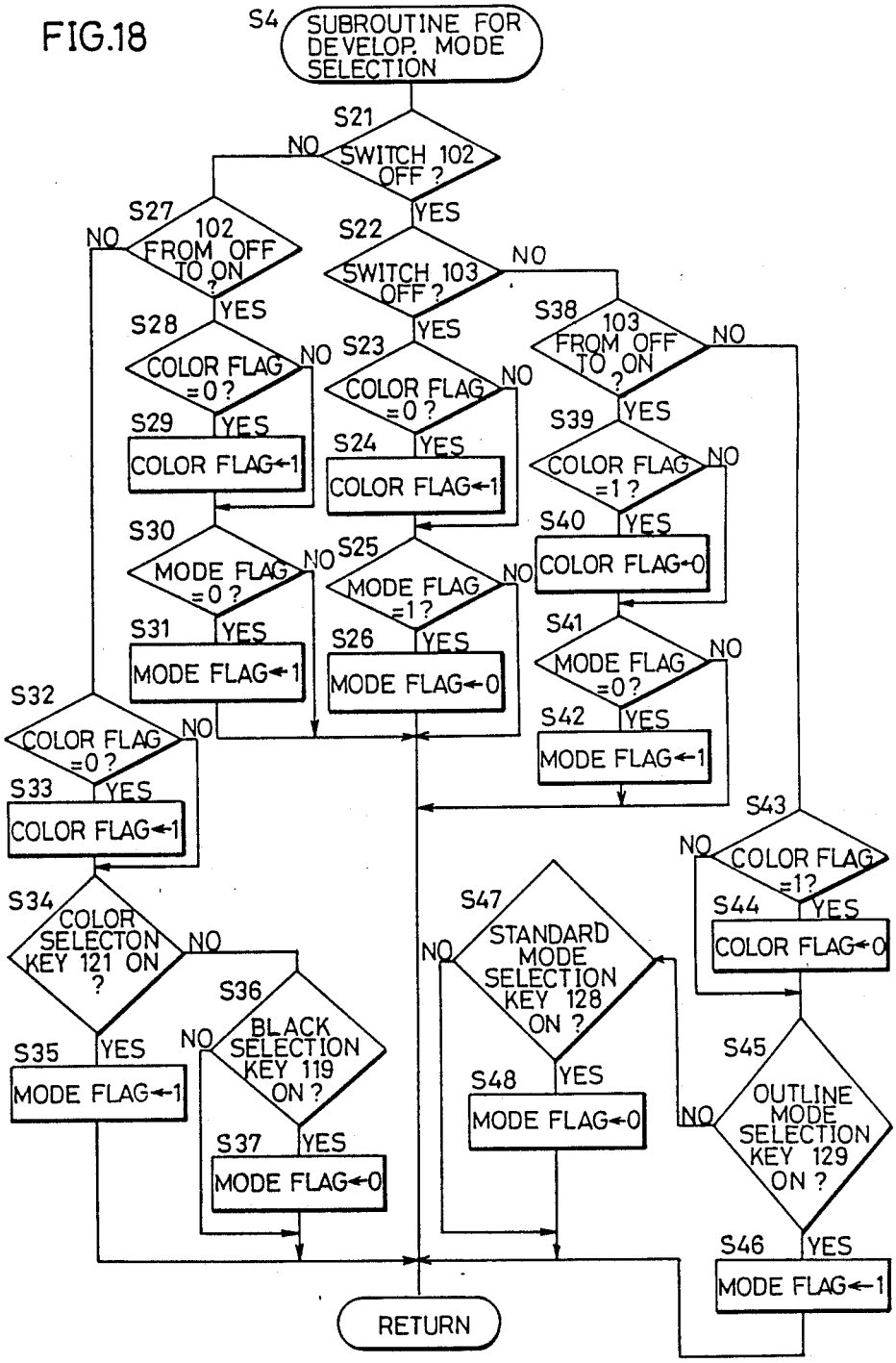
FIG. 18 is a flow chart of a developing mode selection subroutine included in the main routine of FIG. 16, applied to the first embodiment.

FIG. 18 shows a subroutine for developing mode selection executed in the step S4.

First, in the step S21, the CPU 80 determines whether the switch 102 for detecting the first developing device 4 is turned off or not. If it is turned off, the step S22 is applied. If it is turned on, the step S27 is applied. In the step S22, the CPU 80 determines whether the switch 103 for detecting the outline image forming unit 10 is turned off or not. If it is turned off, the step S23 is applied. If it is turned on, the step S38 is applied.

If it is determined that the both of the conditions in the steps S21 and S22 are satisfied, the CPU 80 determines in the step S23 whether a color flag is 0 or not. If it is 0, the color flag is set to 1 in the step S24. Further, the CPU 80 determines in the step S25 whether a mode flag is 1 or not. If it is 1, the mode flag is reset to 0 in the step S26 and then program is returned to the main routine. More specifically, if neither the first developing device 4 nor the outline image forming unit 10 is mounted in the copying apparatus, the color flag is set to 1 and the mode flag is reset to 0, and then, the second developing device 5 is set to the operation mode.

If it is determined in the step S21 that the switch 102 is turned on, which means that the first developing device 4 is mounted, the CPU 80 determines in the step S27 whether the switch 102 in the off state is just turned on or not. If so, the CPU 80 executes the procedures of the steps S28 et seq. If not, the CPU 80 executes the procedures of the steps S32 et seq. In the step S28, the CPU 80 determines whether the color flag is 0 or not. If the color flag is 0, the color flag is set to 1 in the step S29. Further, the CPU 80 determines in the step S30 whether the mode flag is 0 or not. If the mode flag is 0, the mode flag is set to 1 in the step S31 and then the program is returned to the main routine. Thus, if the first developing device 4 has been just mounted, the color flag and the mode flag are set to 1 and the first developing device 4 is set to the operation mode.

If it is determined in the step S27 that the switch 102 is continuously turned on, the CPU 80 determines in the step S32 whether the color flag is 0 or not. If the color flag is 0, the color flag is set to 1 in the step S33. Further, the CPU 80 determines in the step S34 whether the color selection key 121 is turned on or not and determines in the step S36 whether the black selection key 119 is turned on or not. If the selection key 121 is turned on, the CPU 80 sets the mode flag to 1 in the step S35 and instructs the program to return to the main routine. If the selection key 119 is turned on, the mode flag is reset to 0 in the step S37 and then the program is returned to the main routine. If neither of the selection keys 121 and 119 is turned on, the CPU 80 instructs return to the main routine without changing the state of the mode flag. More specifically, if the color selection key 121 is turned on with the first developing device 4 being mounted, the mode flag is set to 1 (with the color flag being 1), and the first developing device 4 is set to the operation mode. On the other hand, if the black selection key 119 is turned on, the CPU 80 resets the mode flag to 0 (with the color flag being 1). and sets the second developing device 5 to the operation mode. Further, if neither of the selection keys 121 and 119 is turned, the CPU 80 maintains the developing mode set theretofore.

On the other hand, if it is determined in step S22 that the switch 103 is turned on, which means that the outline image forming unit 10 is mounted, the CPU 80 determines in the step S38 whether the switch 103 in the off state is just turned on or not. If so, the CPU 80 executes the procedures of the steps S39 et seq. If not, the CPU 80 executes the procedures of the steps S43 et seq. In the step S39, the CPU 80 determines whether the color flag is 1 or not. If the color flag is 1, the color flag is reset to 0 in the step S40. Further, the CPU 80 determines in the step S41 whether the mode flag is 0 or not. If the mode flag is 0, the mode flag is set to 1 in the step S42 and then the program is returned to the main routine. Thus, if the unit 10 has been just mounted, the color flag is reset to 0 and the mode flag is set to 1, and then, the unit 10 and the second developing device 5 are set to the operation mode.

If it is determined in the step S38 that the switch 103 is continuously turned on, the CPU 80 determines in the step S43 whether the color flag is 1 or not. If the color flag is 1, the color flag is reset to 0 in the step S44. Subsequently, the CPU 80 determines in the step S45 whether the outline image forming mode selection key 129 is turned on or not and determines in the step S47 whether the standard copy mode selection key 128 is turned or not. If the selection key 129 is turned on, the CPU 80 sets the mode flag to 1 in the step S46 and then instructs the program to return to the main routine. If the selection key 128 is turned on, the CPU 80 resets the mode flag to 0 in the step S48 and then instructs the program to return to the main routine. If neither of the selection keys 129 and 128 is turned on, the CPU 80 instructs the program to return to the main routine without changing the state of the mode flag. More specifically, if the outline image forming mode selection key 129 is turned on with the unit 10 being mounted, the mode flag is set to 1 (with the color flag being 0) and the unit 10 and the second developing device 5 are set to the operation mode. On the other hand, if the standard copy mode selection key 128 is turned on, the mode flag is reset to 0 (with the color flag being 0), and the second developing device 5 is set to the operation without operating the unit 10. Further, if neither of the selection keys 129 and 128 is turned on, the CPU 80 maintains the developing mode set theretofore.

Figure 19:
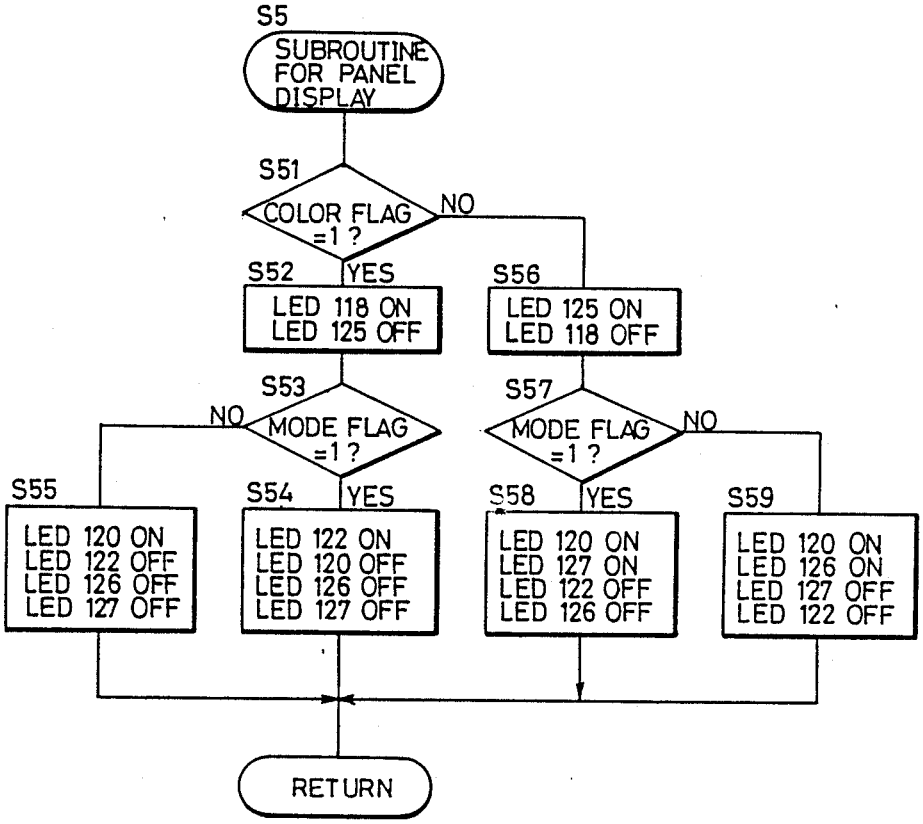
FIG. 19 is a flow chart of a panel display subroutine included in the main routine of FIG. 16, applied to the first embodiment.

FIG. 19 shows a subroutine for panel display executed in the step S5. In this subroutine, the display LED's are turned on or off according to the developing mode set in the subroutine of the step S4.

More specifically, the CPU 80 determines first in the step S51 whether the color flag is 1 or not. If it is 1, the color mode display LED 118 is turned on and the outline image forming mode display LED 125 is turned off in the step S52. Subsequently, the CPU 80 determines in the step S53 whether the mode flag is 1 or not. If it is 1, the step S54 is applied. If it is not 1, the step S55 is applied. In the step S54, the CPU 80 turns on the color mode display LED 122 and turns off the other mode display LED's 120, 126 and 127, and then, the CPU 80 instructs return to the main routine. In the step S55, the CPU 80 turns on the black mode display LED 120 and turns off the other display LED's 122, 126 and 127 and then it instructs return to the main routine.

On the other hand, if it is determined in the step S51 that the color flag is 0, the CPU 80 turns on the outline image forming mode display LED 125 and turns off the color mode display LED 118 in the step S56. Subsequently, the CPU 80 determines in the step S57 whether the mode flag is 1 or not. If it is 1, the step S58 is applied. If it is not 1, the step S59 is applied. In the step S58, the CPU 80 turns on the black mode display LED 120 and the outline image forming mode display LED 127 and turns off the other display LED's 122 and 126, and then it instructs return to the main routine. In the step S59, the CPU 80 turns on the black mode display LED 120 and the standard copy mode display LED 126 and turns off the outline image forming mode display LED 127 and the color mode display LED 122, and then, it instructs return to the main routine.

Figure 20A:
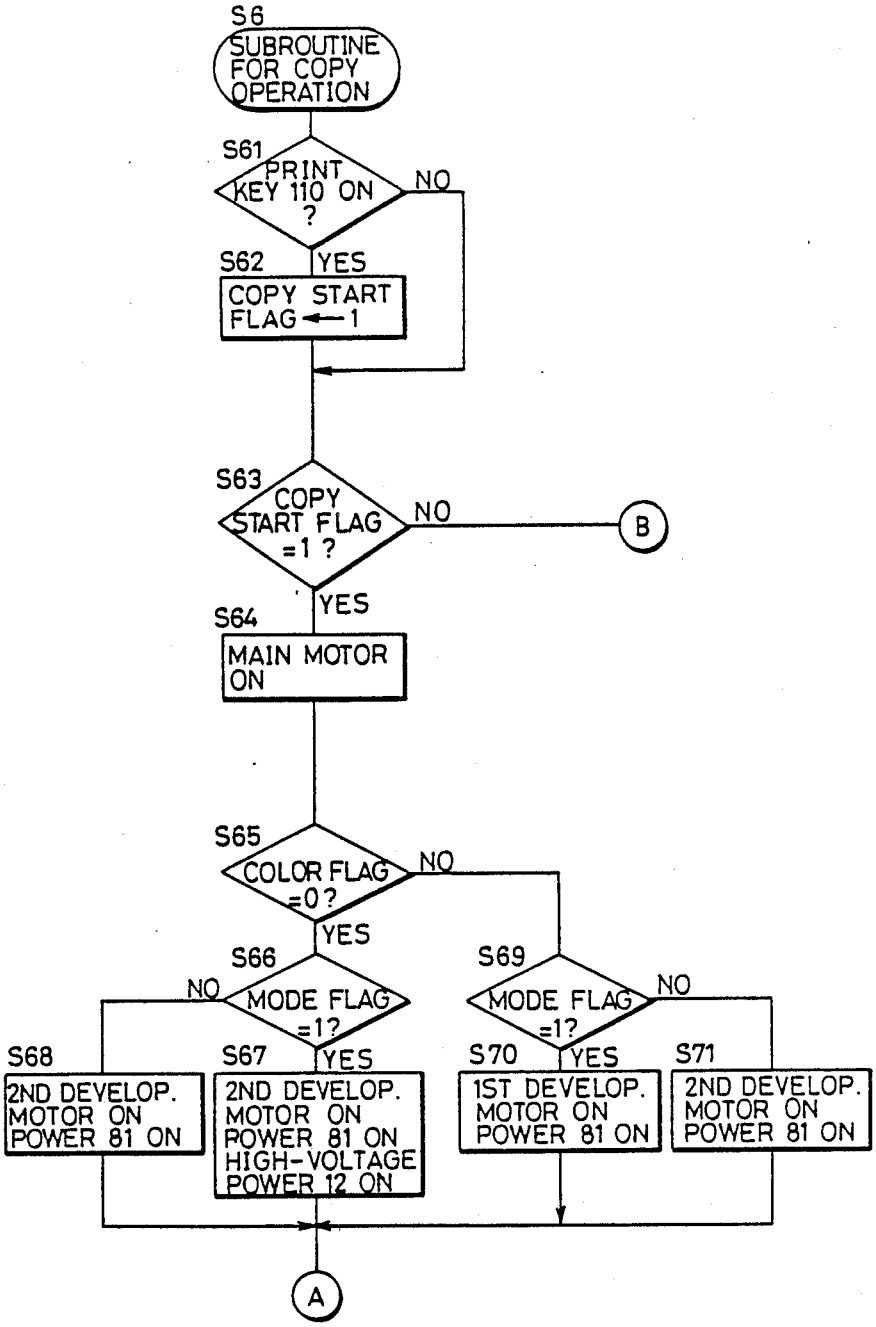
FIG. 20A to 20C are flow charts of a copy operation subroutine included in the main routine of FIG. 16, applied to the first embodiment.
Figure 20B:
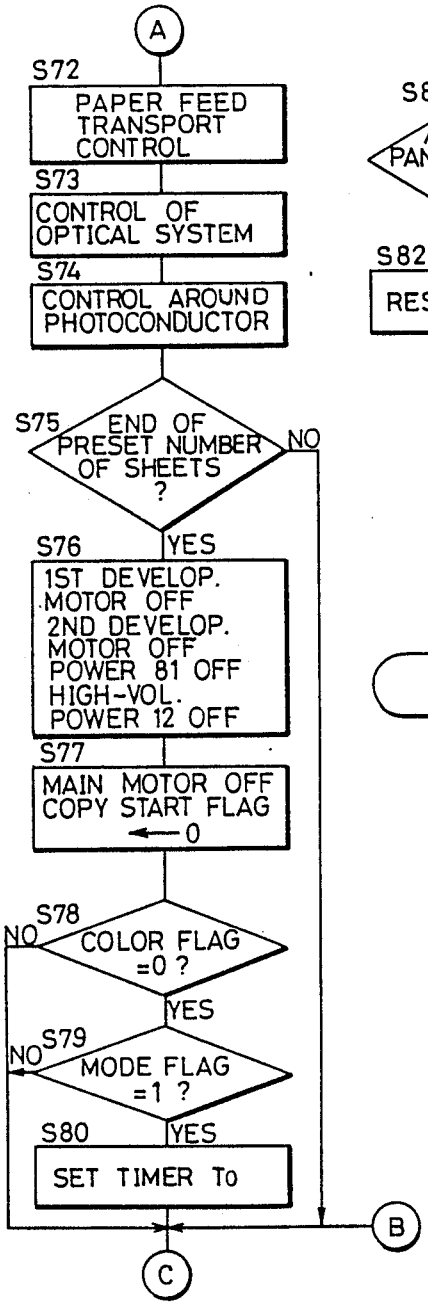
Figure 20C:
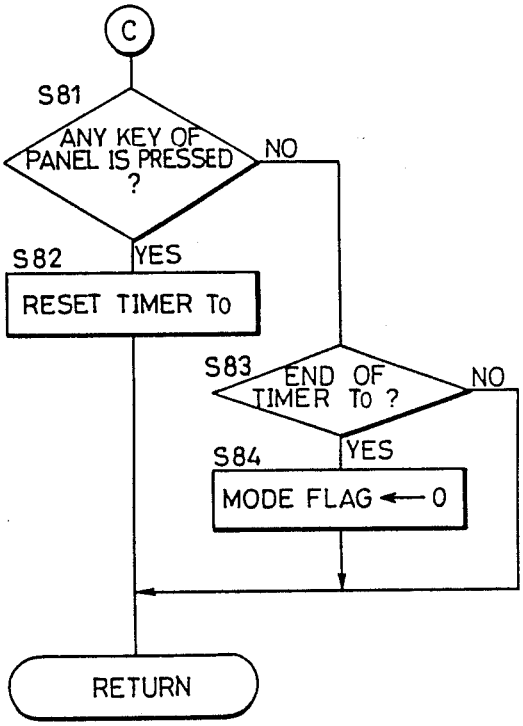

FIGS. 20A, 20B and 20C show a subroutine for copy operation executed in the step S6.

First, the CPU 80 determines in the step S61 whether the print key 110 is turned on or not. If it is not turned on, the step S63 is applied. If it is turned on, the copy start flag is set to 1 in the step S62 and then the step S63 is applied. Thus, the copy start flag is set to 1 when the print key 110 is turned on, and is reset to 0 at an end of the copy operation in the step S77.

Then, the CPU 80 determines in the step S63 whether the copy start flag is 1 or not. If it is reset to 0, the step S81 described below is applied. If the copy start flag is set to 1, the CPU 80 turns on the main motor in the step S64 and determines in the step S65 whether the color flag is 0 or not. In either case, that is, if the color flag is 0 or not 0 it is determined in the step S66 or S69 whether the mode flag is 1 or not. If the color flag is 0 and the mode flag is 1, which means that the outline image forming mode is selected, the CPU 80 turns on the second developing device 5 as well as the developing bias voltage supply 81 and the high-voltage supply 12 in the step S67 and then the step S72 is applied. If the color flag and the mode flag are both 0, which means that the standard copy mode with black toner is selected, the CPU 80 turns on the motor of the second developing device 5 as well as the developing bias voltage supply 81 in the step S68 and then the step S72 is applied. If the color flag and the mode flag are both 1, which means that the standard copy mode with color toner is selected, the CPU 80 turns on the motor of the first developing device 4 as well as the developing bias voltage supply 81 in the step S70 and then the step S72 is applied. If the color flag is 1 and the mode is flag 0, which means that the standard copy mode with black toner is selected, the CPU 80 turns on the motor of the second developing device 5 as well as the developing bias voltage supply 81 in the step S71 in the same manner as in the step S68, and then the step S72 is applied.

Subsequently, paper feed and transport control is executed in the step S72; control of the optical system 3 is executed in the step S73; and control of the chargers etc. around the photoconductor drum 1 is executed in the step S74. Since those control procedures are well-known, description thereof is omitted. Further, the CPU 80 determines in the step S75 whether copy operation of a predetermined number of sheets is completed or not. If it is not completed, the step S81 is applied. If it is completed, the motors of the developing devices 4 and 5, the developing bias voltage supply 81 and the high-voltage supply 12 are turned off in the step S76. Subsequently, the main motor is turned off and the copy start flag is reset to 0 in the step S77.

Then, the CPU 80 determines in the step S78 whether the color flag is 0 or not, and determines in the step S79 whether the mode flag is 1 or not. If either of the two conditions is not satisfied, the step S81 is applied. If both of the conditions are satisfied, which means that copy operation in the outline image forming mode is performed, the timer To is set in the step S80.

In the step S81, the CPU 80 determines whether any key on the operation panel is turned on or not. If any key is turned on, the CPU 80 resets the timer To in the step S82 and instructs return to the main routine. If any key is not turned on, and if the CPU 80 confirms an end of measuring operation of the timer To, it resets the mode flag to 0 in the step S84. More specifically, if the outline image forming mode generally less frequently used is selected and if any key on the operation panel is not turned on within a predetermined period set in the timer To after an end of copy operation, the standard copy mode generally more frequently used is automatically selected. Thus, erroneous operation in the outline image forming mode in the subsequent copy process can be avoided.

An electrophotographic copying apparatus according to the present invention is not limited to the above described embodiment and various variants may be adopted within the scope of the invention. For example, the developing bias voltage applied to the developer sleeve 51 of the second developing device 5 in the outline image forming mode may be obtained by overlapping DC voltage with AC voltage. The thus obtained voltage will be particularly effective in the case of using magnetic insulating toner. If magnetic insulating toner is used, a threshold value exists due to magnetic restrictions and accordingly, the developing bias voltage value Vb in the outline image forming mode in the above described embodiment can be set to a value slightly lower than the surface potential of the central portion of the image area A where the potential is lowered in the second charging step.

In addition, although DC voltage is applied to the scorotron-charger 11 as the second charging device in the above described embodiment, AC voltage may be applied thereto. Such an example is shown in FIGS. 11 and 12A to 12C.

Referring to FIGS. 11 and 12A to 12C, description is made of the case in which AC voltage is applied to the scorotron-charger 11. The scorotron-charger 11 execute second charging onto the drum surface on which the formation of an electrostatic latent image has been already performed. The charge wire 18 is connected with the AC power supply 19, while the grid 15 is connected with the power supply 13. The power supply 19 applies an AC voltage to the charge wire 18. On the other hand, the power supply 13 applies, to the grid 15, such voltage as being sufficiently lower than the surface potential in the non-image background areas and having the same polarity as that of the static charger 2. It is necessary that the voltage applied to the grid 15 is higher than the surface potential in the electrostatic latent image areas, the potential thereat having being lowered considerably under the action of the exposure device 3.

Polarities and voltages of the chargers and other components are similar to those adopted in the foregoing example. However, it should be noted that the voltage of the power supply 19 applied to the scorotron-charger 11 is specified a AC plus/minus 6.0 kV when insulating toner is non-magnetic. With use of magnetic insulating toner, the voltage may be same as above, that is, AC plus/minus 6.0 kV.

The outline image forming process adopted in this example will be described stepwise hereinbelow.

(i) First charging step

The surface of the photoconductor drum 1 is supplied with electric charge at a predetermined constant level under the action of the static charger 2. The surface potential of the drum 1 is also set to +600V.

(ii) Exposure step

Figure 12A:
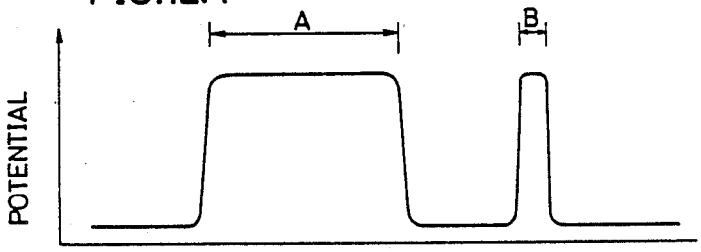
FIGS. 12A to 12C are diagrams showing potentials in electrostatic latent image areas in the steps of the copying method in the case of FIG. 11.
Figure 12B:
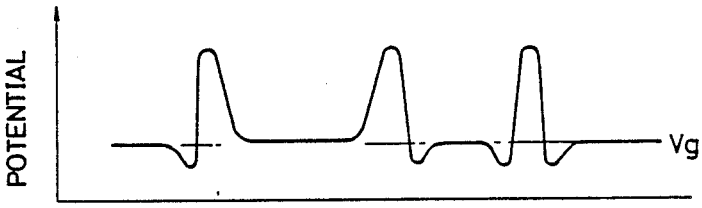
Figure 12C:
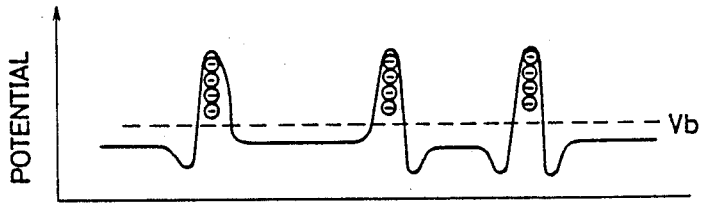

An original image is exposed and projected onto the thus charged surface of the drum 1 by using the slit exposure system as conventionally, thereby to provide a corresponding electrostatic latent image on the drum 1. As shown in FIG. 12A, the static charge in the image areas A and B remains at +600V, while those in the non-image background areas will be reduced to +100V or so under the influence of the light projection. As the original image, positive one may be used in the same manner as in the foregoing example.

(iii) Second charging step.

The surface of the drum 1 having the electrostatic latent image thereon is subjected to a recharging step by using the scorotron-charger 11, to which the AC voltage is applied. At this time, the grid 15 is charged with a voltage of +200V from the power supply 13. This voltage applied to the grid 15 is sufficiently lower than the surface potential of +600V in the electrostatic latent image areas A and B, and higher than the surface potential of +100V in the non-image background areas, said voltage being, however, of the same polarity as that adopted in the first charging step.

Figure 11:
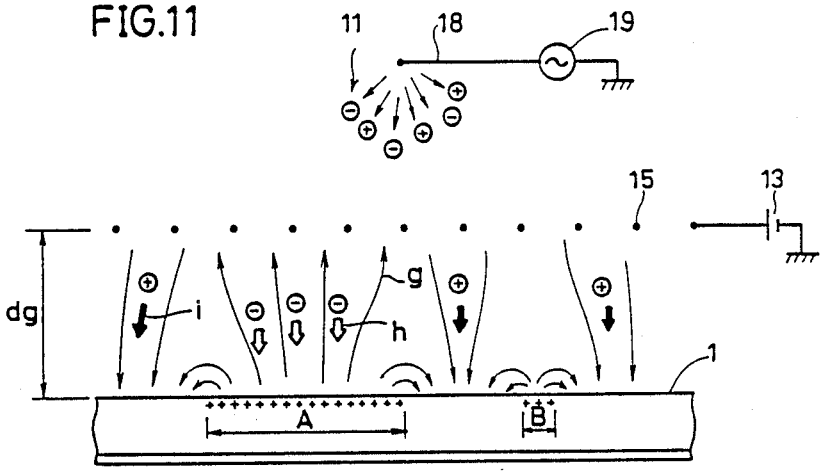
FIG. 11 is an illustration of electric force lines in the second charging step of another copying method applied to the first and second embodiments.

Lines of electric force as schematically shown by arrows g in FIG. 11 are present between the surface of the drum 1 and the grid 15. Negative and positive ions issuing from the charge wire 18 supplied with the AC voltage are subjected to conveying forces along these line of electric force. In this case, the effective lines of force for accelerating negative ions in proximity of the grid 15 toward the drum surface are only those which exist in substantive part of the image area devoid of and inside of the peripheral outline portions of these image areas A and B. Therefore, these negative ions, as shown by double-lined arrows h, impinge exclusively upon the substantive part of the image areas A and B devoid of inside peripheral zones of these imaged areas, as an example. As a result, the static potential level in these ion-impinged image areas will be caused to lower to such a low level as corresponding substantially to the grid voltage of +200V.

On the other hand, the positive ions will go ahead, as shown by thickened small arrows i, toward the non-image background areas exclusive of the outline portion of the image area A for elevating the prevailing electric charges thereat, whereby the corresponding potential rises to a level nearly equal to the grid voltage of +200V.

In other words, the surface potential of the drum prevailing at inside peripheries along the image areas A and B remains at the initial high potential level substantially equal to +600V and with a substantially constant width, while the potential in the substantive part of the image area A is lowered to a potential level substantially equal to the grid voltage Vg of +200V.

On the contrary, the non-image marginal portions per se, remain at a certain lower potential level, nearly 100V, while in the other non-image portions, the potential will rise to a value nearly equal to the grid voltage Vg of +200V. The surface potential in the strip-shaped image area B will not show almost any reduction, the width of the charged portion being subjected to a certain reduction in size.

Thus, in the second charging step, the peripheral outlines of these image areas A and B are formed in the shape of statically positive latent image, also in this case.

(iv) Developing step

The electrostatic latent image formed in the foregoing second charging step and in the form of positive one, is now subjected to a developing step under the action of the developing device 5.

The developing conditions and mechanism adopted in this step are substantially similar to those which were adopted in the foregoing example.

In sum, it should be noted that the surface potentials, prevailing not only in the latent image areas, but also in the non-image background areas, have been elevated considerably in the second charging step, thereby to prevent otherwise conventionally possible superfluous and fouling toner deposition.

In this way, the negatively charged insulating toner is relably deposited at higher potential portions of the surface of the drum 1, or more specifically at the marginal outline portions inside around the substantive portions the image areas A and B, hereby a kind of sharp and clear "inside-embroidering" toner image being effectively produced upon execution of the regular and normal developing job.

In the above described examples, toner adheres to the high-potential portions of the electrostatic latent image to form the outline image. However, toner may adhere to low-potential portions of the electrostatic latent image to form an outline image. This example is shown in FIGS. 13 and 14A to 14C. In the following, this example will be briefly described.

The photoconductor drum 1 is charged at a predetermined potential level of +600V.

Figure 14A:
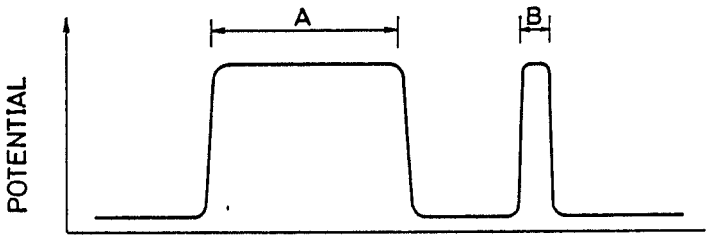
FIG. 14A to 14C are diagrams showing potentials in electrostatic latent image areas in the steps of the copying method in the case of FIG. 13.

The drum 1 is then exposed to a positive original image to form an electrostatic latent image thereon as shown in FIG. 14A. In this case, the image areas A and B are at +600V, while the non-image areas are at +100V.

The drum 1 is recharged by the scorotron-charger 11 supplied with a positive high voltage from the power supply 19*a* upon execution of the exposure. The charge at the scorotron-charger 11 is of the same polarity as that adopted in the first charging step, while the voltage applied to the grid 15 is slightly lower than that prevailing in the image areas and sufficiently higher than that prevailing in the non-image areas. In this case, the voltage of +500V is applied to the grid 15. As a result, the non-image areas devoid of the outline portions of the image areas are considerably elevated nearly to the grid potential of +500V. Therefore, only the outline portions have a lower potential than that of the other portions, as shown in FIG. 14B.

The negative outline image thus formed is developed by a reversal development. More specifically, the positively charged toner particles will be deposited onto only the lower potential portions, i.e., the outline portions outside around the image areas A and B as shown in FIG. 14C by applying, for example, a voltage of +400V as a developing bias voltage. This developing bias voltage is selected to be slightly lower than the grid voltage for preventing the superfluous and fouling toner deposition not only in the non-image area but also in the images areas.

Figure 13:
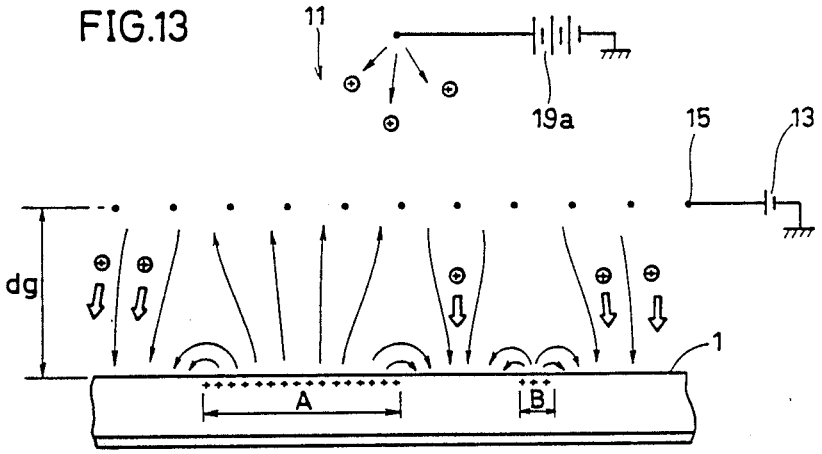
FIG. 13 is an illustration of electric force lines in the second charging step of a further copying method applied to the first and second embodiments.
Figure 14B:
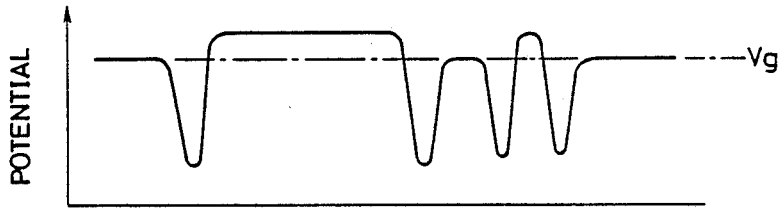
Figure 14C:
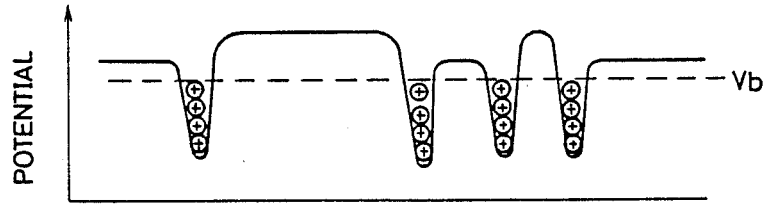
Figure 15A:
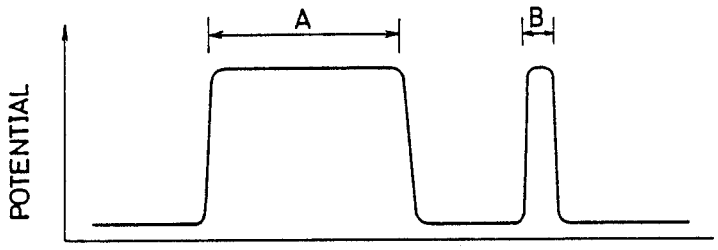
FIGS. 15A to 15C are diagrams showing potentials in electrostatic latent image areas in the steps of a still further copying method applied to the first and second embodiments.
Figure 15B:
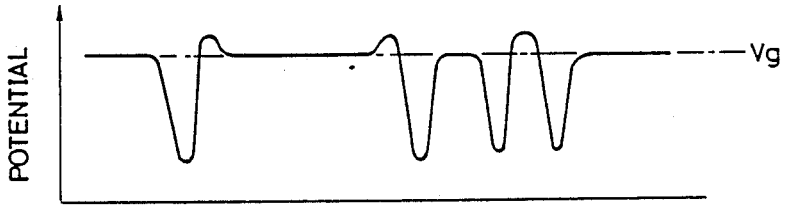
Figure 15C:
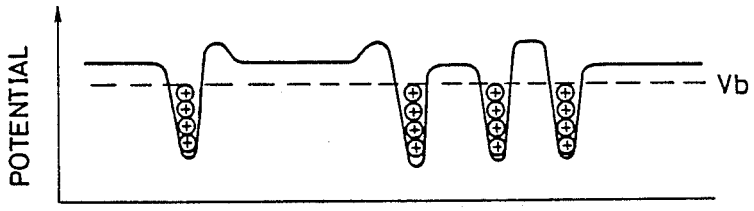

Although DC voltage is applied to the scorotron-charger 11 in the described example in connection with FIG. 13 to 14C, an AC voltage may be applied thereto. Potentials in such a case are shown in FIGS. 15A to 15C. In this case, in the second charging step, the surface potential of the central portion of the electrostatic latent image area A is lowered nearly to the grid voltage and the surface potential of the non-image area rises to a value almost equal to the grid voltage except for the outer outline portions, as is different from the case shown in FIGS. 14A to 14C.

In addition, although the positive original image is used to form the positive outline image in the above described examples, a negative original image may be used to form a positive outline image. In the following, a first method and a second method for forming a positive outline image using a negative original image will be described.

[First Method]

The photoconductor drum 1 is charged at a predetermined potential level of +600V.

The drum 1 is then exposed to a negative original image to form an electrostatic latent image thereon. In this case, the image areas amount to +100V, while the non-image areas amount to +600V.

The drum 1 is recharged by the scorotron-charger 11 upon execution of the exposure. The charge at the scorotron-charger 11 is of the same polarity as that adopted in the first charging step, while the voltage applied to the grid 15 is slightly lower than that prevailing in the non-image areas, and sufficiently higher than that prevailing in the image areas. In this case, the voltage of +500V is applied to the grid 15. As a result, the image areas devoid of the outline portions are considerably elevated nearly to the grid potential of +500V. Therefore, only the outline portions have a potential lower than that in the other portions.

The negative outline image thus formed is developed by a reversal development. More specifically, the positively charged toner particles will be deposited only onto the lower potential portions, i.e., the outline portions by applying, for example, a voltage of +400V as a developing bias voltage. This developing bias voltage is selected to be slightly lower than the grid voltage to prevent superfluous and fouling toner deposition not only in the non-image areas but also in the image areas.

[Second Method]

The photoconductor drum 1 is charged at a predetermined potential level of +600V.

The drum 1 is then exposed to a negative original image to form an electrostatic latent image thereon. In this case, the image areas amount to +100V, while the non-image areas amount to +600V.

The drum 1 is recharged by the scorotron-charger 11 upon execution of the exposure. The charge at the scorotron-charger 11 is of the polarity opposite to that adopted in the first charging step, while the voltage applied to the grid 15 is sufficiently lower than that prevailing in the non-image areas, and slightly higher than that prevailing in the image areas. In this case, the voltage of +200V is applied to the grid 15. As a result, the non-image areas devoid of the outline portions of the image areas are considerably decreased nearly to the grid potential of +200V. Therefore, only the outline portions have a potential higher than that in the other portions.

The positive outline image thus formed is developed by a normal development. More specifically, the negatively charged toner particles will be deposited only onto the higher potential portions, i.e., the outline portions by applying, for example, a voltage of +300V as a developing bias voltage. This developing bias voltage is selected to be slightly higher than the grid voltage for the purpose of preventing superfluous and fouling toner deposition not only in the non-image areas but also in the image areas.

Second Embodiment

A second embodiment of the present invention will be described in the following.

Figure 21:
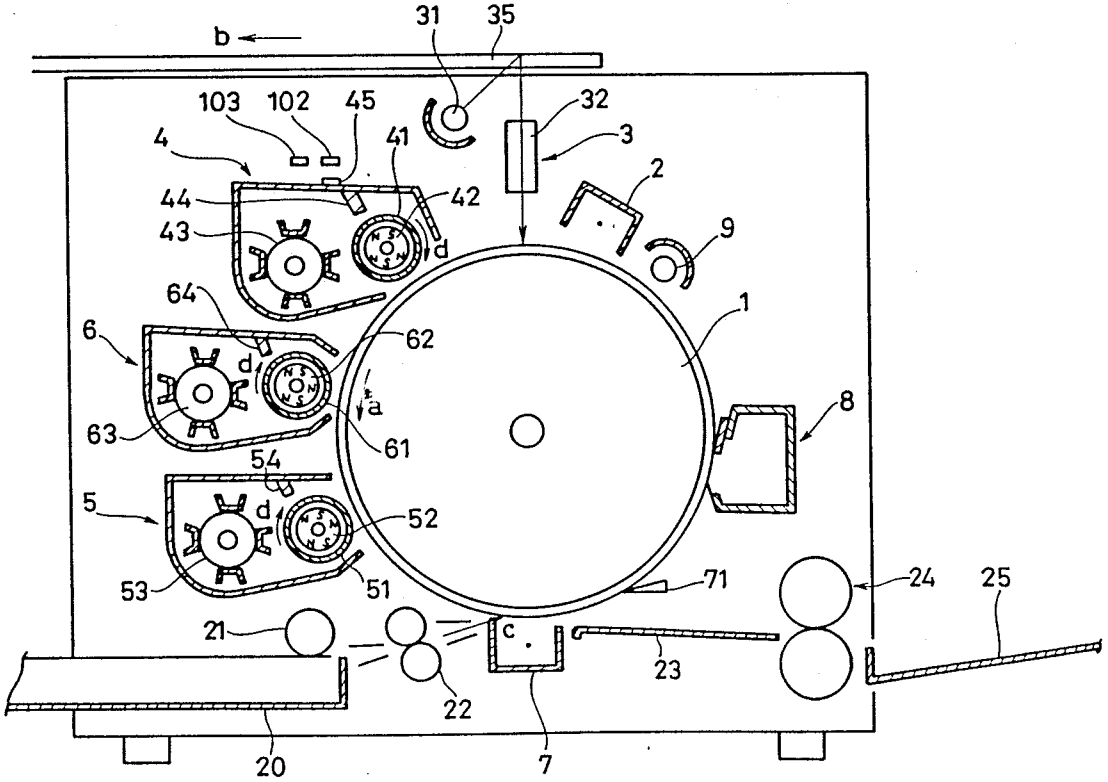
FIG. 21 is a schematic view of an electrophotographic copying apparatus of the preferred second embodiment of the present invention, in which a first developing device is mounted.
Figure 22:
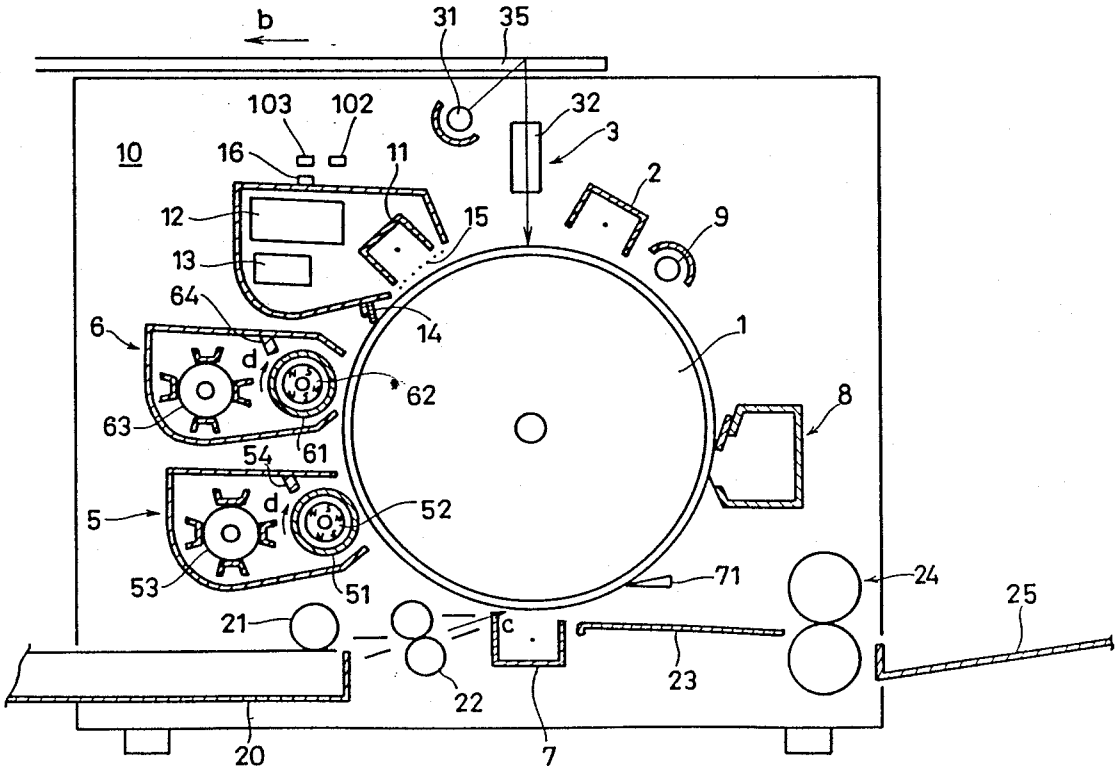
FIG. 22 is a schematic view of the electrophotographic copying apparatus of the second embodiment, in which an outline image forming unit is mounted in place of the first developing device.

FIGS. 21 and 22 schematically show an electrophotographic copying apparatus of this embodiment. FIG. 21 shows a case in which the first developing device 4 is mounted in the apparatus and FIG. 22 shows a case in which the outline image forming unit 10 is mounted in the apparatus in place thereof. This embodiment is different from the first embodiment in that a third developing device 6 is provided between the first developing device 4 and the second developing device 5. Other features are same as in the first embodiment shown in FIGS. 1 and 2. The first developing device 4 is replaceable by the outline image forming unit 10 in the same manner as in the first embodiment. The first developing device 4, the second developing device 5 and the third developing device 6 are used to cause an electrostatic latent image formed on the surface of the photoconductor drum 1 to be a visible toner image by using a magnetic brush system, in the same manner as in the case of the first embodiment. The developing devices 4 and 5 have the same construction as that in the first embodiment. The third developing device 6 has a developer sleeve 61 and a bucket roller 63 for agitation of developer, similarly to the developing devices 4 and 5. The developer sleeve 61 has a magnet roller 62 fixedly mounted inside the sleeve. A third motor (not shown) for driving the developing device 6 is provided similarly to the developing devices 4 and 5. The first developing device 4 has, developer containing first color toner (i.e., blue toner in this embodiment). The third developing device 6 has developer containing second color toner (i.e., red toner in this embodiment). The second developing device 5 has developer containing black toner. Any of the developing devices 4, 5 and 6 is selectively used in the standard copy mode described below.

The developer is mixture of magnetic carrier and insulating toner, as in the case of the first embodiment. In the same manner as in the first developing device 4 and the second developing device 5, the developer in the third developing device 6 is held in a brush form on the surface of the developer sleeve 61 by magnetic force of the magnetic roller 62 and while the height of the developer is regulated by a developer height regulator plate 64, the developer is fed in a direction of the arrow d by rotation of the developer sleeve 61, thereby to develop the electrostatic latent image formed on the surface of the photoconductor drum 1.

External shapes and internal connections of the first developing device 4 and the outline image forming unit 10 are same as those shown in FIGS. 3 to 5B in the first embodiment and therefore description thereof is omitted.

Figure 23:
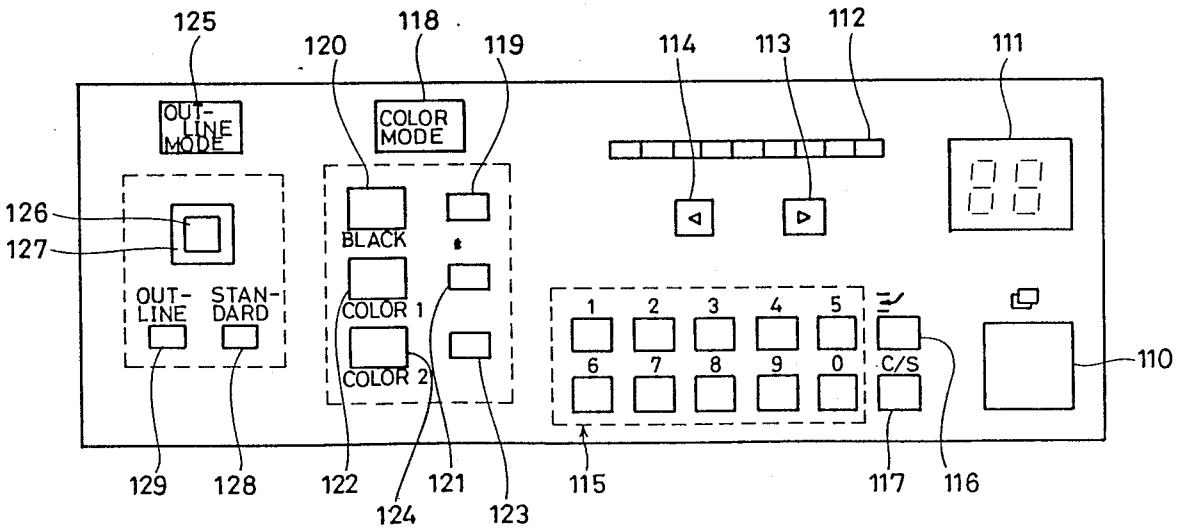
FIG. 23 is a plan view of an operation panel in the second embodiment.

The operation panel shown in FIG. 23 is different from the operation panel shown in FIG. 6 of the first embodiment in that a plural number of color selection keys and color display LED's are provided corresponding to the number of developing devices. Other features of the operation panel of FIG. 23 are same as those of the operation panel of FIG. 6. A color-1 selection key 121 is used to select copy in the first color (i.e., blue in this embodiment) by operation of the first developing device 4. If this key 121 is operated, a display LED 122 is turned on. A color-2 selection key 123 is used to select copy in the second color (i.e., red in this embodiment) by operation of the third developing device 6. If this key 123 is operated, a display LED 124 is turned on.

In this second embodiment, either the developing device 5 or the developing device 6 can be selected when the outline image forming mode is selected. Thus, an outline image of the second color (red) can be formed by using the key 123 and an outline image of black can be formed by using the key 119, selectively. This is because the outline image forming unit 10 is mounted instead of the most upstream first developing device and accordingly the two developing devices 5 and 6 are located downstream of the unit 10.

Even in the state in which the outline image forming unit 10 is mounted, an image corresponding to an original image with a 1:1 relation can be formed if copy operation is performed with the scorotron-charger 11 being turned off. A selection key 128 serves to select copy operation in such a case. Also in this case, either the developing device 5 or the developing device 6 can be selected by using the key 123 or 119.

Figure 24:
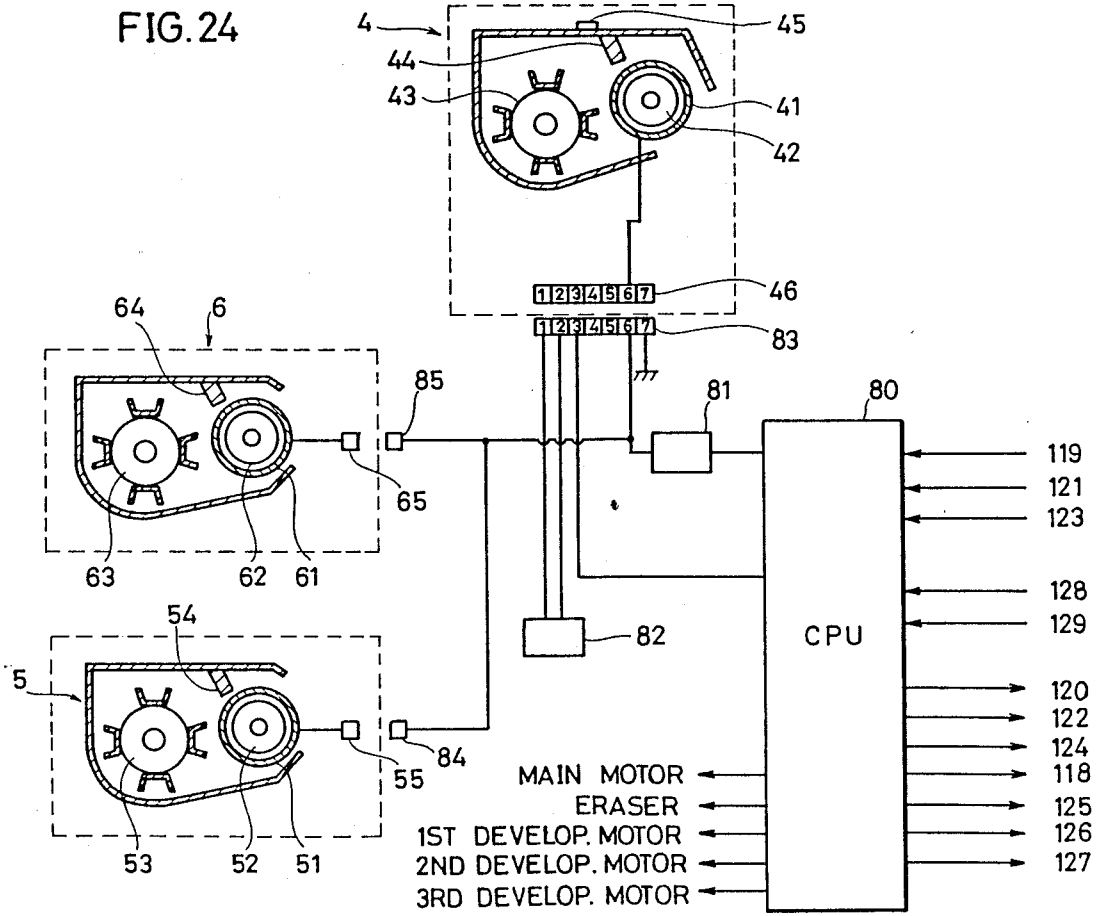
FIG. 24 is a block diagram of a control circuit, in which the first developing device is mounted in the second embodiment.
Figure 25:
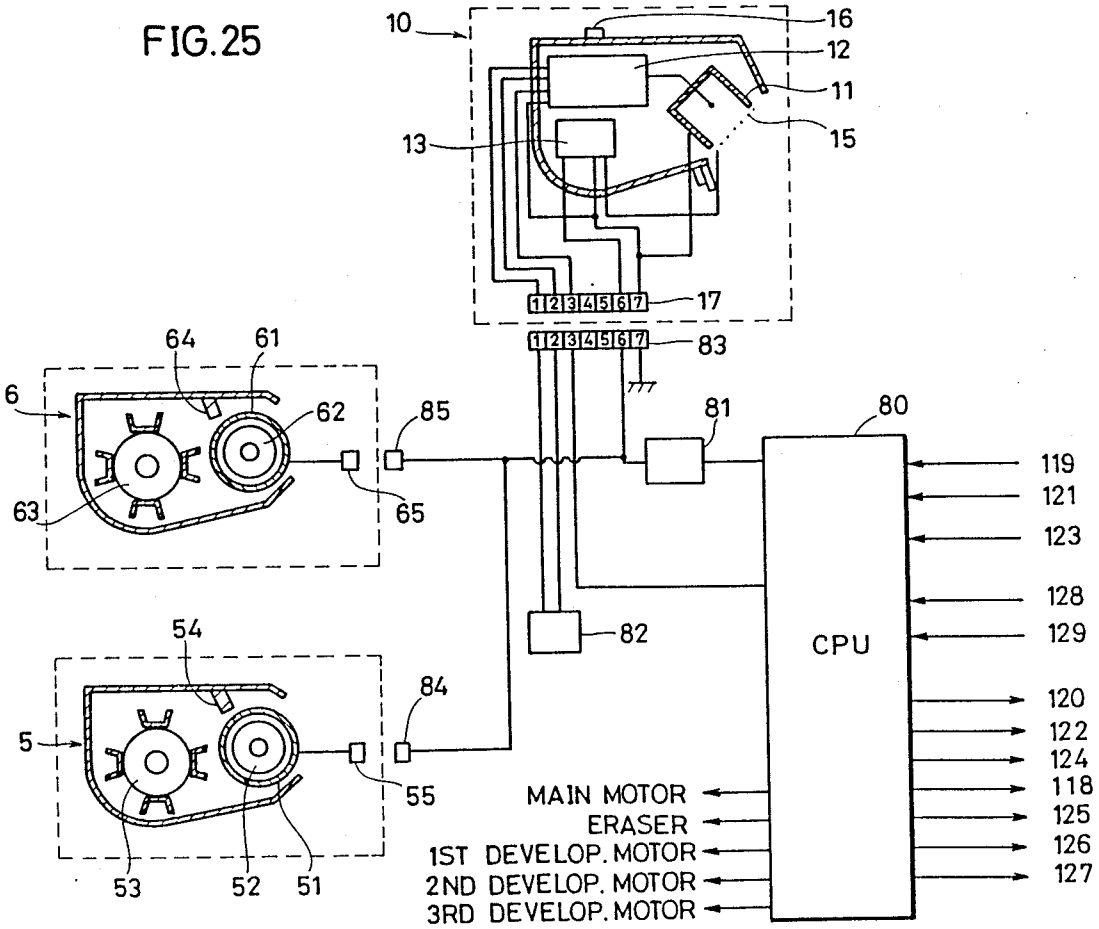
FIG. 25 is a block diagram of a control circuit, in which the outline image forming unit is mounted in the second embodiment.

FIGS. 24 and 25 show a control circuit in the second embodiment. Particularly, FIG. 24 shows a case in which the first developing device 4 is mounted and FIG. 25 shows a case in which the outline image forming unit 10 is mounted in place thereof.

Control procedures are executed by a CPU 80 of a microcomputer as the center in the same manner as in the first embodiment. More specifically, the CPU 80 receives signals for turning on or off the selection keys 119, 121, 123, 128 and 129, and outputs signals for turning on or off the display LED's 118, 120, 122, 124 to 127 etc. Further, the CPU 80 outputs signals for turning on or off the main motor of the copying apparatus, the eraser lamp 9, the first, second and third developing motors etc.

The power supply 81 for developing bias voltage is controlled by a signal from the CPU 80 so that a predetermined bias voltage is applied t the sixth pin of the connector 83 and to the connectors 84 and 85. The DC power supply 82 is connected to the first pin and the second pin of the connector 83. The third pin thereof is connected to the CPU 80 and the seventh pin thereof is grounded.

The connector 17 or 46 is automatically connected in the same manner as in the first embodiment when the outline image forming unit 10 or the first developing device 4 is mounted in the main body of the copying apparatus.

When the first developing device 4 is mounted, the predetermined developing bias voltage is applied to the developer sleeve 41 through the sixth pins of the connectors 83 and 46, as shown in FIG. 24.

When the outline image forming unit 10 is mounted, a constant voltage of +24V is applied from the DC power supply 82 to the high-voltage power supply 12 through the first and second pins of the connectors 83 and 17. An active state and a non-active state of the output of the high-voltage power supply 12 operated by the DC power supply 82 are controlled by the CPU 80 through the third pins of the connectors 83 and 17. A bias voltage is applied from the developing bias voltage power supply 81 to the potential divider 13 through the sixth pins of the connectors 83 and 17 and it is lowered to a predetermined voltage in the potential divider 13 so as to be applied to the grid 15.

The developing device 5 has a connector connected to the developer sleeve 51 and the developing device 6 has a connector 65 connected to the developer sleeve 61. A predetermined developing bias voltage is applied from the developing bias voltage power supply 81 to the developer sleeve 51 of the second developing device 5 through the connectors 84 and 55. The predetermined developing bias voltage is also applied from the developing bias voltage power supply 81 to the developer sleeve 61 of the third developing device 6 through the connectors 85 and 65.

Since the voltage is applied to the outline image forming unit 10, the developing devices 4, 5 and 6 are same as in the respective examples of the first embodiment, description thereof is omitted. In addition, the outline image forming method is also the same as in the first embodiment and accordingly description thereof is omitted. In this second embodiment, a developing step is executed by the second developing device 5 or the third developing device 6. Therefore, outlines in color (red) or black are obtained as a copy image in this second embodiment.

Standard copy mode:

In the standard copy mode, a copy image corresponding to an original image with a 1:1 relation is obtained. If the first developing device 4 is mounted, the standard copy mode is automatically selected. In this case, when the selection key 121, 123 or 119 is turned on, the developing device 4, 6 or 5 is selected to perform copy in color (blue or red) or in black. On the other hand, if the outline image forming unit 10 is mounted, copy operation is performed when the selection key 128 is turned on, and also in this case, color selection can be made by turning on the selection key 119 or 123. In this standard copy mode, the first charging step, the exposure step and the second charging step are the same as in the first embodiment and therefore description thereof is omitted.

In the developing step, color (blue or red) or black insulating toner negatively charged by any one selected among the developing devices 4, 6 and 5 is caused to adhere to the image areas on the photoconductor drum 1, whereby a toner image corresponding to the original image with a 1:1 relation is obtained regularly.

Referring to the flow charts of FIGS. 16, 17 and 26–28, control procedures by the CPU 80 will be described. The main routine is the same as shown by the flow chart in FIG. 16 of the first embodiment and the subroutine for erasure is the same as shown by the flow chart in FIG. 17 of the first embodiment.

FIG. 16 shows a main routine of the CPU 80.

When power supply is turned on, the CPU 80 is reset to an initial state. First in the step S1, the CPU 80 performs initialization, that is, it clears an RAM, initializes the registers of the CPU and sets the devices in the initial mode. Then in the step S2, the CPU 80 starts measuring operation of an internal timer. The internal timer determines a period required for one cycle of the main routine irrespective of contents of processing in the respective subroutines. The timer value is set in the step S1.

Subsequently, the CPU 80 successively calls the subroutines of the steps S3 to S7. When processing operations in all of the subroutines are completed, the CPU 80 waits for an end of measuring operation of the internal timer and then instructs return to the step S2.

The subroutine of the step S3 is executed to remove electric charge on the photoconductor drum 1, as described in detail afterwards.

The subroutine of the step S4 is executed to set operating conditions of the developing devices 4, 5 and 6 according to the selected copy mode, as described in detail afterwards.

The subroutine of the step S5 is applied to display, on the operation panel, a copy mode selected by turn-on or turn-off of the mode selection keys 119, 121 etc. of the operation panel, as described in detail afterwards.

The subroutine of the step S6 is executed to control copy operation. Copy operation in a selected copy mode is performed when the print key 110 is turned on. Particularly, if any key on the panel is not operated within a predetermined period after an end of copy operation in the outline image forming mode, the mode is returned to the standard copy mode. This will be described in detail afterwards.

The subroutine of the step S7 is executed to perform other processing such as regulation of a fixation temperature, a detailed description thereof being omitted.

The following table shows operation states of the developing devices 4, 5 and 6 displayed by a color flag, a mode flag A and a mode flag B used in the below described subroutines. In this table, the mark 0 in the column of operation state indicates that the component shown by this mark is set to an operation mode.

TABLE

| | | | | Operation State | | | | |
|---|---|---|---|---|---|---|---|---|
| | | | | Development Motor | | | | |
| Image | Color Flag | Mode Flag A | Mode Flag B | 1st | 2nd | 3rd | High Voltage Supply 12 | Power Supply 81 |
| Red-Standard | 0 | 0 | 0 | | | O | | O |
| Black-Standard | 0 | 0 | 1 | | O | | | O |
| Red-Outline | 0 | 1 | 0 | | | O | O | O |
| Black-Outline | 0 | 1 | 1 | | O | | O | O |
| Black-Standard | 1 | 0 | 0 | | O | | | O |
| Black-Standard | 1 | 0 | 1 | | O | | | O |
| Red-Standard | 1 | 1 | 0 | | | O | | O |
| Blue-Standard | 1 | 1 | 1 | O | | | | O |

FIG. 17 shows a subroutine for erasure to be executed in the above-mentioned step S3.

First, in the step S11, it is determined whether power supply has been just turned on or not (that is, the time elapsed after turn-on of the power supply is within a predetermined period or not). If not, the CPU 80 proceeds to the step S15. If so, the main motor is turned in the step S12 and the eraser lamp 9 is turned on in the step S13. As a result, erasure of electric charge on the photoconductor drum 1 is started. At the same time, the CPU 80 starts measuring operation of a timer TM in the step S14. The timer TM is set to a period required for the erasure.

In the step S15, the CPU 80 determines whether the measuring operation of the timer TM comes to an end or not. If it does not come to an end, the CPU 80 instructs the program to return to the main routine. If it comes to an end, the erasure lamp 9 is turned off in the step S16 and the main motor is turned off in the step S17, and then, the program is returned to the main routine.

Figure 26A:
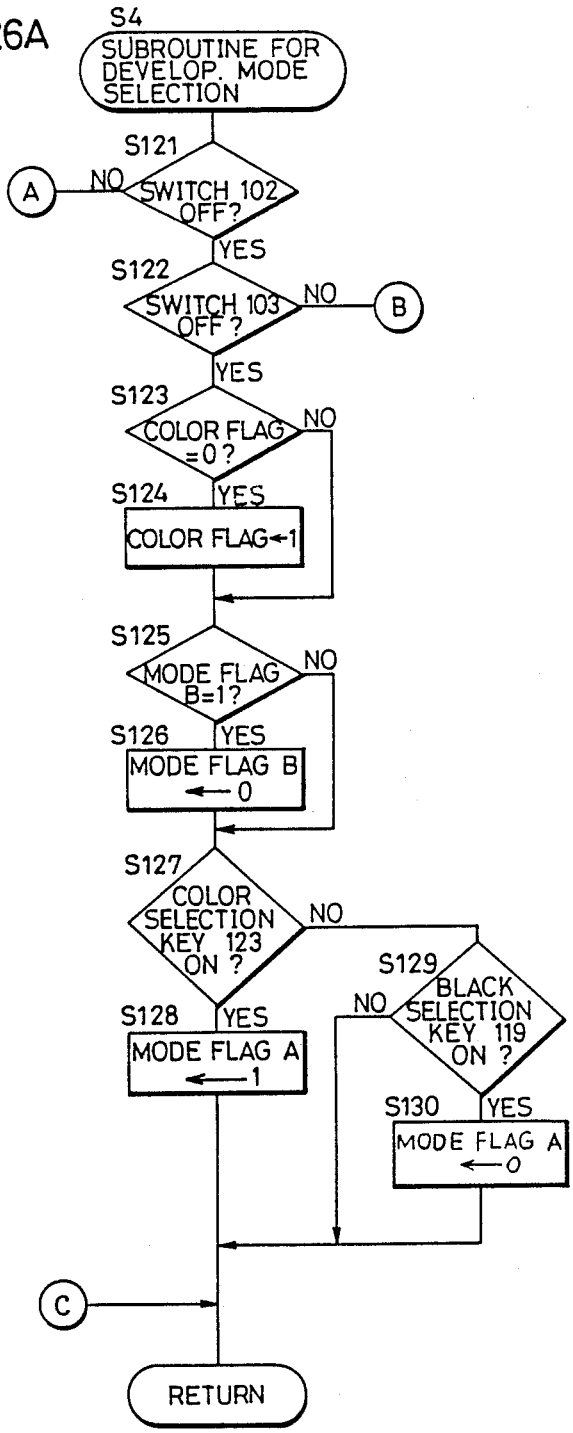
FIGS. 26A to 26C are flow charts of a developing mode selection subroutine applied to the second embodiment.
Figure 26B:
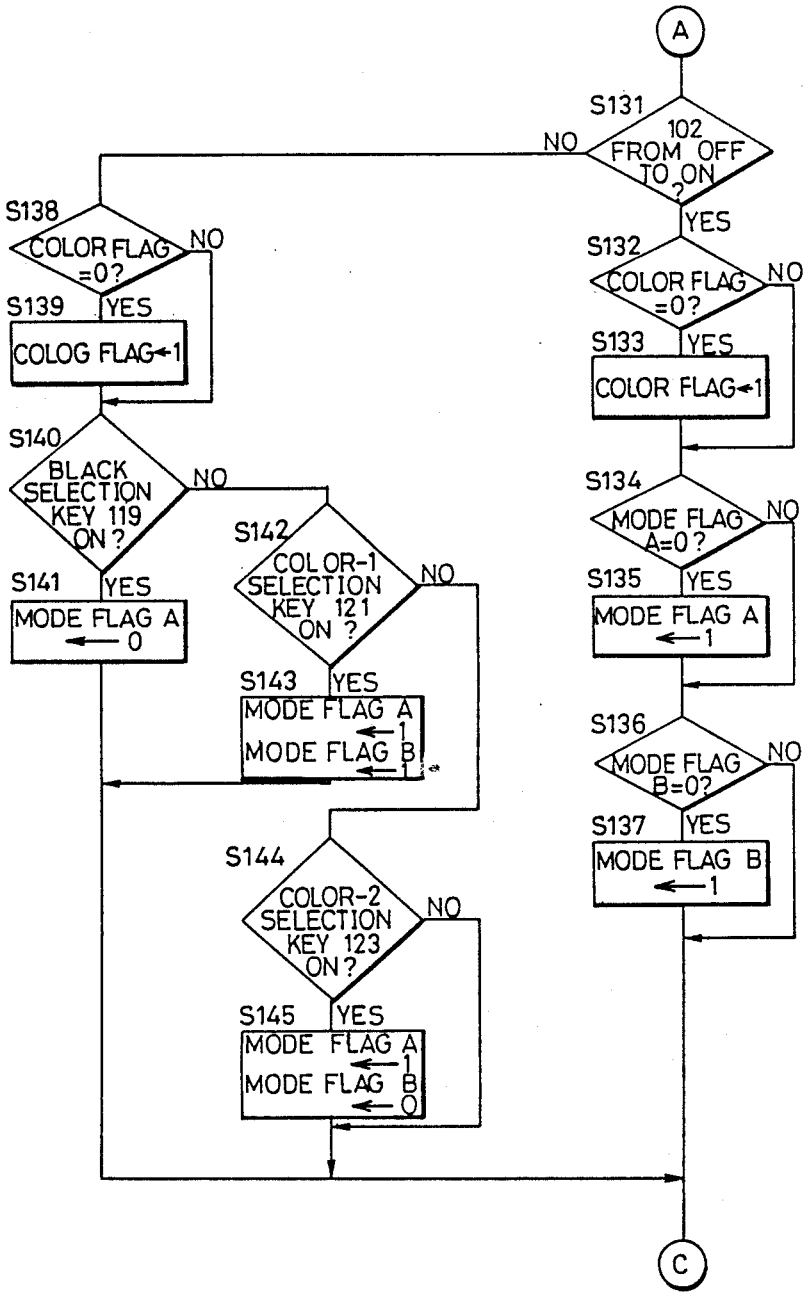
Figure 26C:
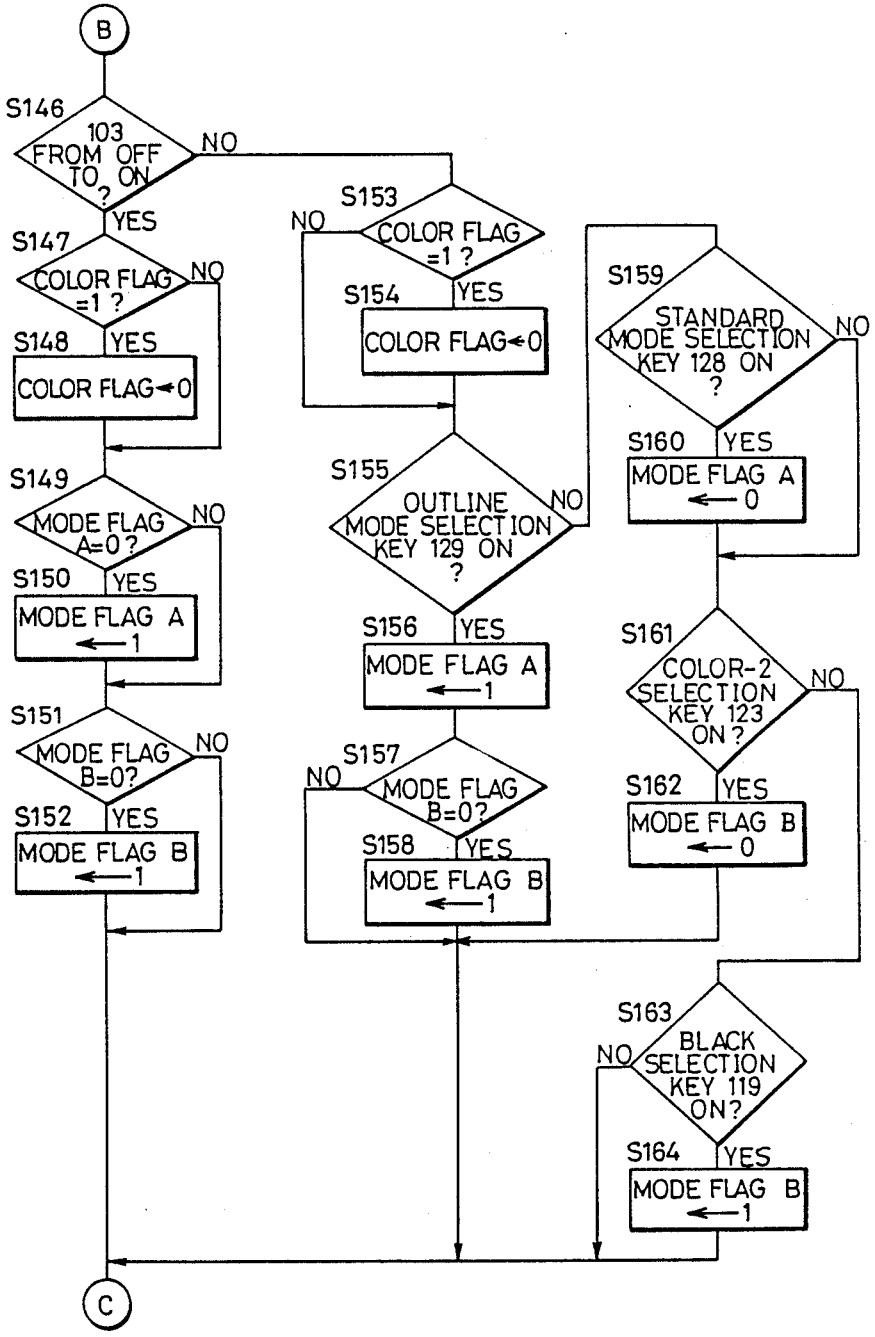

FIGS. 26A, 26B and 26C show a subroutine for developing mode selection executed in the above described step S4.

First, the CPU 80 determines in the step S121 whether the switch 102 for detecting the first developing device 4 is turned off or not. If the switch 102 is turned off, the step S122 is applied. If it is turned on, the step S131 is applied. In the step S122, the CPU 80 determines whether the switch 103 for detecting the outline image forming unit 10 is turned off or not. If the switch 103 is turned off, the step S123 is applied. If it is turned on, the step S146 is applied.

If it is determined that the conditions in the steps S121 and S122 are both satisfied, the CPU 80 determines in the step S123 whether the color flag is 0 or not. If the color flag is 0, the color flag is set to 1 in the step S124. Further, the CPU 80 determines in the step S125 whether the mode flag B is 1 or not. If the mode flag B is 1, the mode flag B is reset to 0 in the step S126 and then the step S127 is applied. In the step S127, the CPU 80 determines whether the color-2 selection key 123 is turned on or not. If it is turned on, the mode flag A is set to 1 in the step S128 and then the program is returned to the main routine. If it is determined in the step S127 that the selection key 123 is not turned on, the CPU 80 determines in the step S129 whether the black selection key 119 is turned on or not. If it is turned on, the mode flag A is reset to 0 in the step S130 and the program is returned to the main routine. If neither the key 119 nor the key 123 is turned on, the program is directly returned to the main routine. More specifically, if neither the first developing device 4 nor the outline image forming unit 10 is mounted, the color flag is set to 1 and the mode flag B is reset to 0. Then, dependent on whether the mode flag A is 0 or 1, the third developing device 6 or the second developing device 5 is set to the operation mode.

If it is determined in the step S121 that the switch 102 is turned on, which means that the first developing device 4 is mounted, the CPU 80 determines in the step S131 whether the switch 102 in the off state is just turned on or not. If this condition is satisfied, the procedures in the steps S132 et seq. are executed. If this condition is not satisfied, the procedures in the steps S138 et seq. are executed. In the step S132, the CPU 80 determines whether the color flag is 0 or not. If the color flag is 0, the color flag is set to 1 in the step S133. Subsequently in the step S134, the CPU 80 determines whether the mode flag A is 0 or not. If the mode flag A is 0, the mode flag A is set to 1 in the step S135. Subsequently in the step S136, the CPU 80 determines whether the mode flag B is 0 or not. If the mode flag B is 0, the mode flag B is set to 1 in the step S137 and then the program is returned to the main routine. In other words, if the first developing device 4 has been just mounted, the color flag, the mode flag A and the mode flag B are set to 1 and the first developing device 4 is set to the operation mode.

If it is determined in the above mentioned step S131 that the switch 102 is continuously turned on, the CPU 80 determines in the step S138 whether the color flag is 0 or not. If the color flag is 0, the color flag is set to 1 in the step S139. Then, the CPU 80 determines in the step S140 whether the black selection key 119 is turned on or not and determines in the step S142 whether the color-1 selection key 121 is turned on or not. Further, in the step S144, it determines whether the color-2 selection key 123 is turned on or not. If the selection key 119 is turned on the mode flag A is reset to 0 in the step S141 and then the program is returned to the main routine. If the selection key 121 is turned on, the mode flag A and the mode flag B are set to 1 in the step S143 and then the program is returned to the main routine. If the selection key 123 is turned on, the CPU 80 sets the mode flag A to 1 and resets the mode flag B to 0 and then the program is returned to the main routine. If any of the selection keys 123, 121 and 119 is not turned on, the CPU 80 instructs return to the main routine with the state of the mode flag being unchanged.

More specifically, if the black selection key 119 is turned on with the first developing device 4 being mounted, the mode flag A is reset to 0 (while the color flag is 1) and the second developing device 5 (for copy in black) is set to the operation mode. If the color-1 selection key 121 is turned on, the mode flag A and the mode flag B are set to 1 (while the color flag is 1) and the first developing device 4 (for copy in blue) is set to the operation mode. If the color-2 selection key 123 is turned on, the mode flag A is set to 1 and the mode flag B is reset to 0, and then, the third developing device 6 (for copy in red) is set to the operation mode.

If any of the selection keys 123, 121 and 119 is not turned on, the developing mode set theretofore is maintained.

On the other hand, if it is determined in the step S122 that the switch 103 is turned on, which means that the outline image forming unit 10 is mounted, the CPU 80 determines in the step S146 whether the switch 103 in the off state is just turned on or not. If so, the CPU 80 executes the procedures in the steps S147 et seq. If not, it executes the steps S153 et seq. In the step S147, the color flag is 1, the color flag is reset to 0 in the step S148. Further, the CPU 80 determines whether the mode flag A is 0 or not. If the mode flag A is 0, the flag A is set to 1 in the step S150. Subsequently, the CPU 80 determines in the step S151 whether the mode flag B is 0 or not. If the mode flag B is 0, the mode flag B is set to 1 in the step S152 and then the program is returned to the main routine. In other words, if the unit 10 has been just mounted, the color flag is reset to 0 and the mode flag A and the mode flag B are set to 1, and then, the unit 10 and the second developing device 5 (for copy in black) are set to the operation mode. In this second embodiment, if the mode flag B is 0 in the step S151, it is set to 1 in the step S152 as described above. However, the mode flag B may be maintained to be 0. In such a case, the third developing device 6 is set to the operation mode and an outline image in red can be obtained.

If it is determined in the above mentioned step S146 that the switch 103 is continuously turned on, the CPU 80 determines in the step S153 whether the color flag is 1 or not. If the color flag is 1, it is reset to 0 in the step S154. Then, the CPU 80 determines in the step S155 whether the outline image forming mode selection key 129 is turned on or not, and determines in the step S159 whether the standard copy mode selection key 128 is turned on or not If the selection key 129 is turned on, the CPU 80 sets the mode flag A to 1 in the step S156. Subsequently, the CPU 80 determines in the step S157 whether the mode flag B is 0 or not. If the mode flag B is 0, it is set to 1 in the step S158 and then the program is returned to the main routine.

If the selection key 128 is turned on, the CPU 80 resets the mode flag A to 0 in the step S160. Then, the CPU 80 determines in the step S161 whether the color-2 selection key 123 is turned on or not, and determines in the step S163 whether the black selection key 119 is turned on or not. If the selection key 123 is turned on, the mode flag B is reset to 0 in the step S162. If the selection key 119 is turned on, the mode flag B is set to 1 in the step S164. Then, the program is returned to the main routine. If any of the selection keys 129, 128, 123 and 119 is not turned on, the CPU 80 maintains the states of the mode flag A and the mode flag B unchanged and instructs return to the main routine.

More specifically, if the outline image forming mode selection key 129 is turned on with the unit 10 being mounted, the mode flag A and the mode flag B are set to 1 (while the color flag is 0) and the unit 10 and the second developing device 5 (for copy in black) are set to the operation mode. On the other hand, if the standard copy mode selection key 128 is turned on, the mode flag A is reset to 0 (while the color flag is 0) and the second developing device 5 or the third developing device 6 is set to the operation mode without operating the unit 10. Then, dependent on the state 1 or 0 of the mode flag B, either the second developing device 5 or the third developing device 6 is selectively operated. In addition, if any of the selection keys 129, 128, 123 and 119 is not turned on, the developing mode set theretofore is maintained.

Figure 27:
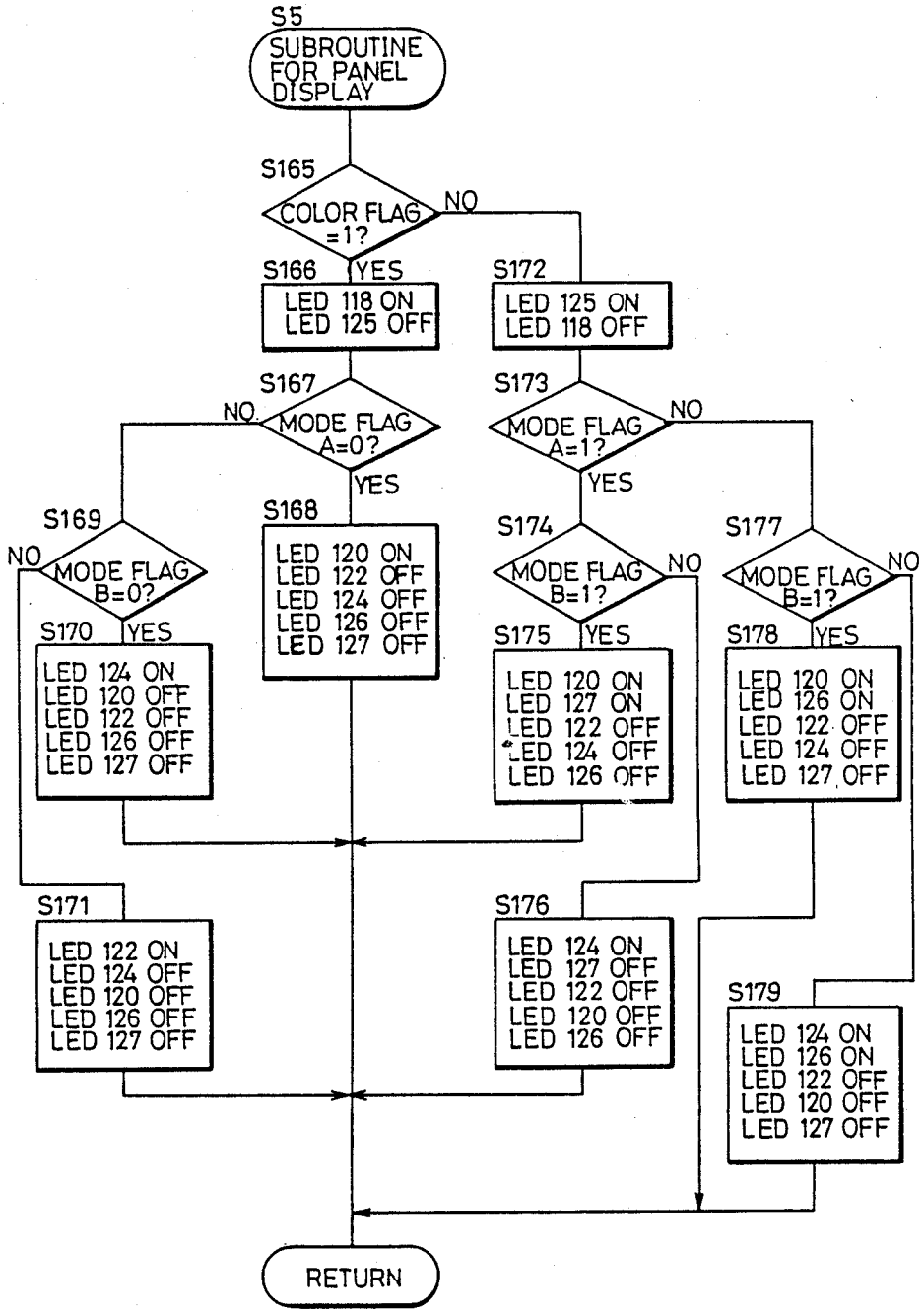
FIG. 27 is a flow chart of a panel display subroutine applied to the second embodiment.

FIG. 27 shows a subroutine for panel display executed in the above mentioned step S5. In this subroutine, the display LED's are turned on or off according to the developing mode set in the subroutine of the step S4.

More specifically, the CPU 80 first determines in the step S165 whether the color flag is 1 or not. If it is 1, the CPU 80 turns on the color mode display LED 118 and turns off the outline image forming mode display LED 125 in the step S166. Further, the CPU 80 determines in the step S167 whether the mode flag A is 0 or not. If it is 0, the step S168 is applied. If it is not 0, the step S169 is applied. In the step S168, the black display LED 120 is turned on and the other display LED's 122, 124, 126 and 127 are turned off. Then, the program is returned to the main routine.

In the step S169, the CPU 80 determines whether the mode flag B is 0 or not. If it is 0, the CPU 80 turns on the color-2 display LED 124 and turns off the other display LED's 120, 122, 126 and 127 and then the program is returned to the main routine. If the mode flag B is 1, the CPU 80 turns on the color-1 display LED 122 and turns off the other display LED's 120, 124, 126 and 127 in the step S171 and then the program is returned to the main routine.

On the other hand, if the color flag is 0, that is, if the condition in the above mentioned step S165 is not met, the CPU 80 turns on the outline image forming mode display LED 125 and turns off the color mode display LED 118 in the step S172. Further, the CPU 80 determines in the step S173 whether the mode flag A is 1 or not. If it is 1, the step S174 is applied. If it is not 1, the step S177 is applied. In the step S174, the CPU 80 determines whether the mode flag B is 1 or not. If the mode flag B is 1, the CPU 80 turns on the black display LED 120 and the outline image forming display LED 127 and turns off the other display LED's 122, 124 and 126 in the step S175 and then it instructs return to the main routine. If the mode flag B is 0, the CPU 80 turns on the color-2 display LED 124 and the outline image forming mode display LED 127 and turns off the other display LED's 120, 122 and 126 in the step S176 and then it instructs return to the main routine.

On the other hand, the CPU 80 determines in the step S177 whether the mode flag B is 1 or not. If the mode flag B is 1, the CPU 80 turns on the black display LED 120 and the standard copy mode display LED 126, and turns off the other display LED's 122, 124 and 127 in the step S178 and then it instructs return to the main routine. If the mode flag B is 0, the CPU 80 turns on the color-2 display LED 124 and the standard copy mode display LED 126, and turns off the other display LED's 122, 120 and 127 in the step S179 and then it instructs return to the main routine.

Figure 28A:
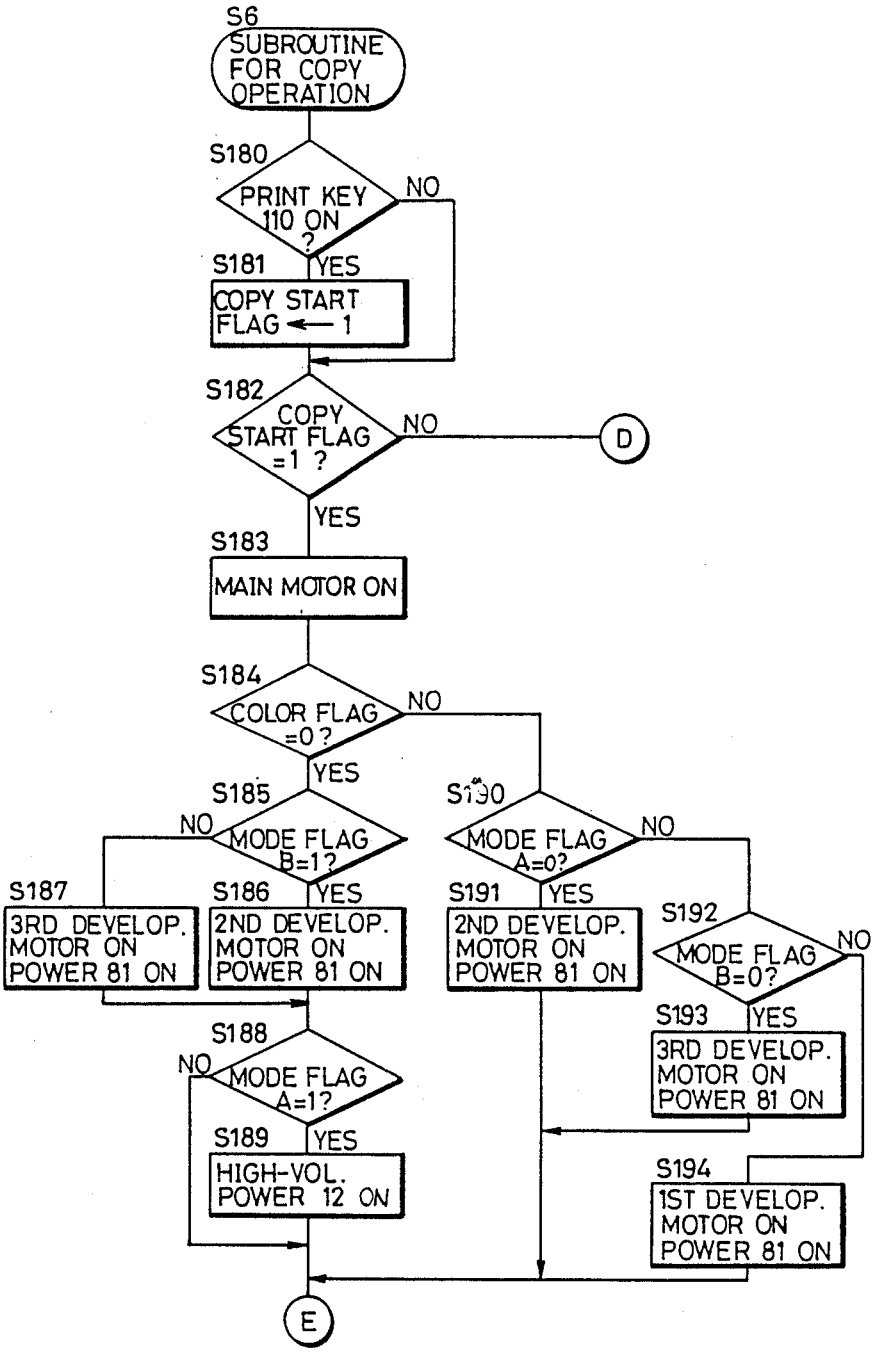
FIGS. 28A and 28B are flow charts of a copy operation subroutine applied to the second embodiment.
Figure 28B:
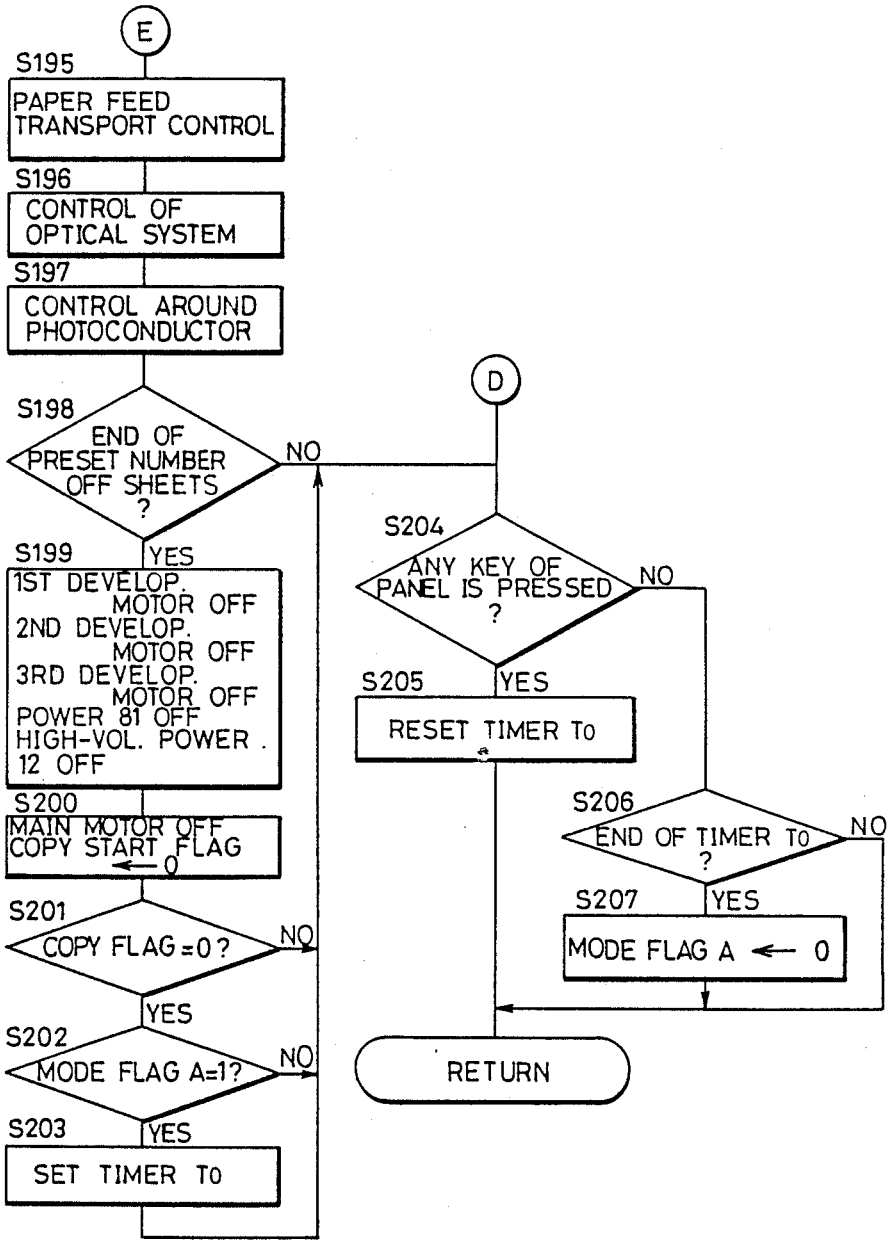

FIGS. 28A and 28B show a subroutine for copy operation executed in the above mentioned step S6.

First, the CPU 80 determines in the step S180 whether the print key 110 is turned on or not. If it is not turned on, the step S182 is applied. If it is turned on, the copy start flag is set to 1 in the step S181 and then the program proceeds to the step S182. Thus, the copy start flag is set to 1 when the print key 110 is turned on, and it is reset to 0 in the step S200 at an end of copy operation.

Subsequently, the CPU 80 determines in the step S182 whether the copy start flag is 1 or not. If it is reset to 0, the program proceeds to the below described step S204. If the copy start flag is set to 1, the CPU 80 turns on the main motor in the step S183 and determines in the step S184 whether the color flag is 0 or not. If the color flag is 0, the step S185 is applied. If the color flag is not 0, the step S190 is applied.

In the step S185, the CPU 80 determines whether the mode flag B is 1 or not. If the mode flag B is 1, the second developing motor and the power supply 81 are turned on in the step S186. If the mode flag B is 0, the third development motor and the power supply 81 are turned on in the step S187. Then, in either case, the program proceeds to the step S188. In the step S188, the CPU 80 determines whether the mode flag A is 1 or not. If the mode flag A is 1, the high-voltage power supply 12 is turned on and then the step S195 is applied.

On the other hand, in the step S190, the CPU 80 determines whether the mode flag A is 0 or not. If the mode flag A is 0, the second development motor and the power supply 81 are turned on in the step S191 and then the step S195 is applied. If the mode flag A is 1, the CPU 80 determines in the step S192 whether the mode flag B is 0 or not. If the mode flag B is 0, the third development motor and the power supply 81 are turned on in the step S193. If the mode flag B is 1, the first development motor and the power supply 81 are turned on in the step S194. Then, in either case, that is, 1 or 0 of the mode flag B, the program proceeds to the step S195.

Subsequently, the CPU 80 executes control procedures as follows: paper feed and transport control in the step S195, control of the optical system 3 in the step S196, and control of the chargers etc. around the photoconductor drum 1 in the step S197. Since those control procedures are well-known, description thereof is omitted. Then, the CPU 80 determines in the step S198 whether copy operation for a predetermined number of sheets is completed or not. If it is not completed, the step S204 is applied. If it is completed, the CPU 80 turns off the motors of the developing devices 4, 5 and 6, the developing bias voltage power supply 81 and the high-voltage power supply 12 in the step S199, and turns off the main motor in the step S200, and then, the copy start flag is reset to 0.

Subsequently, the CPU 80 determines in the step S201 whether the color flag is 0 or not and determines in the step S202 whether the mode flag A is 1 or not. If either of the two conditions is not met, the step S204 is applied. If both of the conditions are met, which means that copy operation in the outline image forming mode has been performed, the timer To is set in the step S203 and then the step S204 is applied.

In the step S204, the CPU 80 determines whether any of the keys on the operation panel is turned on or not. If any key is turned on, the timer To is reset in the step S205 and then the program is returned to the main routine. If any key is not turned on, and if it is determined in the step S206 that measuring operation of the timer To comes to an end, the CPU 80 resets the mode flag A to 0 in the step S207. More specifically, if the outline image forming mode generally less frequently used is selected and if any key on the operation panel is not operated within a predetermined period set in the timer To after an end of copy operation, the standard copy mode more frequently used is automatically selected. Thus, erroneous operation in the outline image forming mode can be avoided on the occasion of a subsequent copy operation.

As described above, in the second embodiment, the outline image forming unit is mounted in place of the first developing device and accordingly by means of the plurality of developing devices located downstream, outline images in black or in color can be easily formed selectively. Thus, the apparatus of the second embodiment becomes more convenient to use.

The electrophotographic copying apparatus of the present invention is not limited to the above described embodiment. Many variants may be adopted within the scope of the invention. For example, various methods as indicated in connection with the first embodiment may be used as the outline image forming methods.

Although the outline image forming unit 10 is mounted in place of the first developing device 4 located most upstream in the second embodiment, other developing devices excluding the most downstream developing device 5, for example, the third developing device 6 may be replaced by the unit 10. In the latter case, an outline image can be developed only by the second developing device 5. In addition, more than three developing devices may be provided.

As is clearly understood from the foregoing description, the present invention includes a plurality developing means so that the second charging means for recharging a latent image can be mounted in replacement of one of the developing means excluding the one located most downstream in the moving direction of the electrostatic latent image bearing member. Thus, it is made possible to provide an electrophotographic copying apparatus not only capable of performing copy operation with black toner and color toner in the standard mode but also capable of recharging a latent image for formation of an outline image without involving any increase in the size of the photoconductor and the size of the copying apparatus.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus comprising:

an electrostatic latent image bearing member having a surface and provided in a movable manner, first charging means for charging the surface of said electrostatic latent image bearing member at a predetermined potential, exposure means for exposing the surface of said electrostatic latent image bearing member charged by said first charging means to an original image, thereby to form an electrostatic latent image thereon, a plurality developing means provided along a direction of movement of said electrostatic latent image bearing member, any one of said plurality of developing means being selectively operated to develop the electrostatic latent image formed by said exposure means, transfer means for transferring the image developed by any one of said plurality of developing means, and second charging means for recharging the image formed on said electrostatic latent image bearing member, said second charging means being able to be mounted in said electrophotographic copying apparatus in place of one of said developing means excluding the developing means located most downstream along the direction of movement of said electrostatic latent image bearing member.

2. An electrophotographic copying apparatus as defined in claim 1, further comprising:

first mode designating means for designating an outline image forming mode for forming an outline image, and second mode designating means for designating a standard mode.

3. An electrophotographic copying apparatus as defined in claim 2, further comprising:

control means for permitting operation of said second charging means in response to designation of the outline image forming mode by said first mode designating means and forbidding operation of said second charging means in response to designation of the standard mode by said second mode designating means.

4. An electrophotographic copying apparatus as defined in claim 2, wherein said second charging means has a grid, and said electrophotographic copying apparatus further comprises voltage applying means for applying, to said grid, a voltage sufficiently lower than a surface potential of an image area of the electrostatic latent image and slightly higher than a surface potential of a non-image area of the electrostatic latent image, so that only outline portions of the latent image are at a high potential.

5. An electrophotographic copying apparatus as defined in claim 2, wherein said second charging means has a grid, and said electrophotographic copying apparatus further comprises voltage applying means for applying, to said grid, a voltage slightly lower than a surface potential of an image area of the latent image and sufficiently higher than a surface potential of a non-image area, so that only outline portions of the latent image are at a low potential.

6. An electrophotographic copying apparatus as defined in claim 2, wherein said second charging means has a grid, and said electrophotographic copying apparatus further comprises voltage applying means for applying, to said grid, a voltage slightly lower than a surface potential of a non-image are of the latent image and sufficiently higher than a surface potential of an image area of the latent image, so that only outline portions of the latent image are at a low potential.

7. An electrophotographic copying apparatus as defined in claim 2, wherein said second charging means has a grid, and said electrophotographic copying apparatus further comprises voltage applying means for applying, to said grid, a voltage sufficiently lower than a surface potential of a non-image area of the latent image and slightly higher than a surface potential of an image area of the latent image, so that only outline portions of the latent image are at a high potential.

8. An electrophotographic copying apparatus comprising:

an electrostatic latent image bearing member having a surface and provided in a movable manner, first charging means for charging the surface of said electrostatic latent image bearing member at a predetermine potential, exposure means for exposing the surface of said electrostatic latent image bearing member charged by said first charging means to an original image, thereby to form an electrostatic latent image thereon, a plurality of developing means provided along a direction of movement of said electrostatic latent image bearing member, any one of said plurality of developing means being selectively operated to develop the electrostatic latent image formed by said exposure means, transfer means for transferring the image developed by any one of said plurality of developing means, second charging means for recharging the electrostatic latent image formed on the surface of said electrostatic latent image bearing member, said second charging means being able to be mounted in said electrophotographic copying apparatus in place of one of the developing means excluding the developing means located most downstream along the direction of movement of said electrostatic latent image bearing member, and control means for automatically selecting a first mode for operating said second charging means to perform copy operation when said second charging means is mounted.

9. An electrophotographic copying apparatus as defined in claim 8, wherein said plurality of developing means each have developer containing toner, and said first mode is an outline image forming mode in which toner adheres only to outline portions of the latent image to cause only the outline portions to be a visible image.

10. An electrophotographic copying apparatus as defined in claim 8, wherein said control means selects the developing means located most downstream along the direction of movement of said electrostatic latent image bearing member when said second charging means is mounted, thereby to perform copy operation in said first mode.

11. An electrophotographic copying apparatus comprising:

an electrostatic latent image bearing member having a surface and provided in a movable manner, first charging means for charging the surface of said electrostatic latent image bearing member at a predetermined potential, exposure means for exposing the surface of said electrostatic latent image bearing member charged by said first charging means to an original image, thereby to form an electrostatic latent image thereon, a plurality of developing means provided along a direction of movement of said electrostatic latent image bearing member, each of said plurality of developing means having developer containing toner and any one thereof being selectively operated to develop the electrostatic latent image formed by said exposure means, transfer means for transferring the image developed by any one of said plurality of developing means, second charging means for recharging the electrostatic latent image formed on the surface of said electrostatic latent image bearing member, said second charging means having a grid and being able to be mounted in said electrophotographic copying apparatus in place of one of the developing means excluding the developing means located most downstream along the direction of movement of said electrostatic latent image bearing member, and a power supply for applying a developing bias voltage to each of said plurality of developing means, said power supply being electrically connected to said grid of said second charging means when said second charging means is mounted in place of one of the developing means.

12. An electrophotographic copying apparatus as defined in claim 11, further comprising: first mode designating means for designating an outline image forming mode for forming an outline image, second mode designating means for designating a standard mode.

13. An electrophotographic copying apparatus as defined in claim 12, further comprising: control means for permitting operation of said second charging means in response to designation of the outline image forming mode and forbidding operation of said second charging means in response to designation of the standard mode.

14. An electrophotographic copying apparatus as defined in claim 12, further comprising: grid voltage applying means for applying, to said grid, a voltage sufficiently lower than a surface potential of an image area of the latent image and slightly higher than a surface potential of a non-image area of the latent image, so that only outline portions of the latent image are at a high potential.

15. An electrophotographic copying apparatus as defined in claim 14, wherein a voltage slightly higher than the voltage applied to the grid is applied from said power supply to a preselected one of the developing means to cause toner to adhere only to the outline portions, when said outline image forming mode is designated by said first mode designating means.

16. An electrophotographic copying apparatus as defined in claim 12, further comprising:

grid voltage applying means for applying, to said grid, a voltage slightly lower than a surface potential of an image area of the latent image and sufficiently higher than a surface potential of a non-image area of the latent image, so that only outline portions of the latent image are at a lower potential.

17. An electrophotographic copying apparatus as defined in claim 16, wherein a voltage slightly lower than the voltage applied to the grid is applied from said power supply to a preselected one of the developing means to cause toner to adhere only to the outline portions, when said outline image forming mode is designated by said first mode designating means.

18. An electrophotographic copying apparatus as defined in claim 12, further comprising:

grid voltage applying means for applying, to said grid, a voltage slightly lower than a surface potential of a non-image area of the latent image and sufficiently higher than a surface potential of an image area of the latent image, so that only outline portions of the latent image are at a low potential.

19. An electrophotographic copying apparatus as defined in claim 18, wherein a voltage slightly lower than the voltage applied to the grid is applied from said power supply to a preselected one of the developing means to cause toner to adhere only to the outline portions, when said outline image forming mode is designated by said first mode designating means.

20. An electrophotographic copying apparatus as defined in claim 12, further comprising:

grid voltage applying means for applying, to said grid, a voltage sufficiently lower than a surface potential of a non-image area of the latent image and slightly higher than a surface potential of an image area of the latent image, so that only outline portions of the latent image are at a high potential.

21. An electrophotographic copying apparatus as defined in claim 20, wherein a voltage slightly higher than the voltage applied to the grid is applied from said power supply to a preselected one of the developing means to cause toner to adhere only to the outline portions, when said outline image forming mode is designate by said first mode designating means.

22. An electrophotographic copying apparatus comprising:

an electrostatic latent image bearing member provided in a movable manner, first charging means for charging a surface of said electrostatic latent image bearing member at a predetermined potential, exposure means for exposing the surface of said electrostatic latent image bearing member charged by said first charging means to an original image, thereby to form an electrostatic latent image thereon, a plurality of developing means provided along a direction of movement of said electrostatic latent image bearing member for developing the electrostatic latent image formed by said exposure means, transfer means for transferring the image developed by any one of said plurality of developing means, second charging means for recharging the electrostatic latent image formed on the surface of said electrostatic latent image bearing member, said second charging means being able to be mounted in said electrophotographic copying apparatus in place of one of the developing means excluding the developing means located most downstream along the direction of movement of said electrostatic latent image bearing member, first mode designating means for designating a first mode for operating said second charging means to form an outline image, and control means for automatic control for operating a preselected one of the developing means in response to designation of said first mode by said first mode designating means.

23. An electrophotographic copying apparatus as defined in claim 22, wherein said first mode is an outline image forming mode in which outline portions of the electrostatic latent image are caused to be a visible image.

24. An electrophotographic copying apparatus comprising:

an electrostatic latent image bearing member provided in a movable manner, first charging means for charging a surface of said electrostatic latent image bearing member at a predetermined potential, exposure means for exposing the surface of said electrostatic latent image bearing member charged by said first charging means to an original image, thereby to form an electrostatic latent image thereon, a plurality of developing means provided along a direction of movement of said electrostatic latent image bearing member, any one of said plurality of developing means being selectively operated to develop the electrostatic latent image formed by said exposure means, transfer means for transferring the image developed by any one of said plurality of developing means, and a unit to be mounted in said electrophotographic copying apparatus in place of one of the developing means excluding the developing means located most downstream along the direction of movement of said electrostatic latent image bearing member, said unit including second charging means for recharging the electrostatic latent image formed on the surface of said electrostatic latent image bearing member, a lower portion of said unit being provided with an insulating seal member to be in contact with the surface of said electrostatic latent image bearing member when said unit is mounted in said electrophotographic copying apparatus.

* * * * *